US012624484B2

(12) United States Patent
Amos

(10) Patent No.: US 12,624,484 B2
(45) Date of Patent: May 12, 2026

(54) TUFTED ARTICLES, AND SYSTEMS AND METHODS FOR MAKING SAME

(71) Applicant: Shaw Industries Group, Inc., Dalton, GA (US)

(72) Inventor: Kim K. Amos, Tunnel Hill, GA (US)

(73) Assignee: Shaw Industries Group, Inc., Dalton, GA (US)

( * ) Notice: Subject to any disclaimer, the term of this patent is extended or adjusted under 35 U.S.C. 154(b) by 0 days.

(21) Appl. No.: 18/946,587

(22) Filed: Nov. 13, 2024

(65) Prior Publication Data

US 2025/0154701 A1 May 15, 2025

Related U.S. Application Data

(60) Provisional application No. 63/598,369, filed on Nov. 13, 2023.

(51) Int. Cl.

| | |
|---|---|
| ***D05C 15/18*** | (2006.01) |
| ***D05C 15/10*** | (2006.01) |
| ***D05C 17/02*** | (2006.01) |

(52) U.S. Cl.
CPC ..... *D05C 15/18* (2013.01); *D05C 15/10* (2013.01); *D05C 17/02* (2013.01)

(58) Field of Classification Search
CPC ..... D05C 15/04; D05C 15/10; D05C 15/18; D05C 17/02
See application file for complete search history.

(56) References Cited

U.S. PATENT DOCUMENTS

| | | | | |
|---|---|---|---|---|
| 3,982,490 | A | 9/1976 | Bury | |
| 4,393,793 | A | 7/1983 | Beasley | |
| 4,549,496 | A * | 10/1985 | Kile | D05C 15/34 112/80.08 |
| 5,165,352 | A * | 11/1992 | Ingram | D05C 15/34 112/80.08 |
| 5,467,724 | A | 11/1995 | Bardsley et al. | |
| 5,588,383 | A | 12/1996 | Davis et al. | |
| 9,677,210 | B2 | 6/2017 | Hall et al. | |
| 10,961,647 | B2 | 3/2021 | Amos et al. | |
| 2024/0068144 | A1* | 2/2024 | Mathews | D05C 15/36 |
| 2025/0059693 | A1* | 2/2025 | Lovelady | D05C 15/36 |

OTHER PUBLICATIONS

International Search Report and Written Opinion was mailed on Feb. 3, 2025 for International Application No. PCT/US2024/055745, which was filed on Nov. 13, 2024 (Applicant-Shaw Industries Group, Inc.)(13 pages).

* cited by examiner

*Primary Examiner* — Nathan E Durham
(74) *Attorney, Agent, or Firm* — Fish & Richardson P.C.

(57) ABSTRACT

Described herein are various systems and methods for forming tufted articles using a hollow needle tufting machine. The systems and methods can be used for tufting different types of yarns, such as turf yarns, staple yarns, or yarns having a denier greater than 5000. A system can have a pair of guides and a clevis movable between the pair of guides. The clevis defines an opening therethrough. The clevis and pair of guides are configured to engage a yarn to so that the yarn contacts only exterior surfaces of the pair of guides.

20 Claims, 12 Drawing Sheets

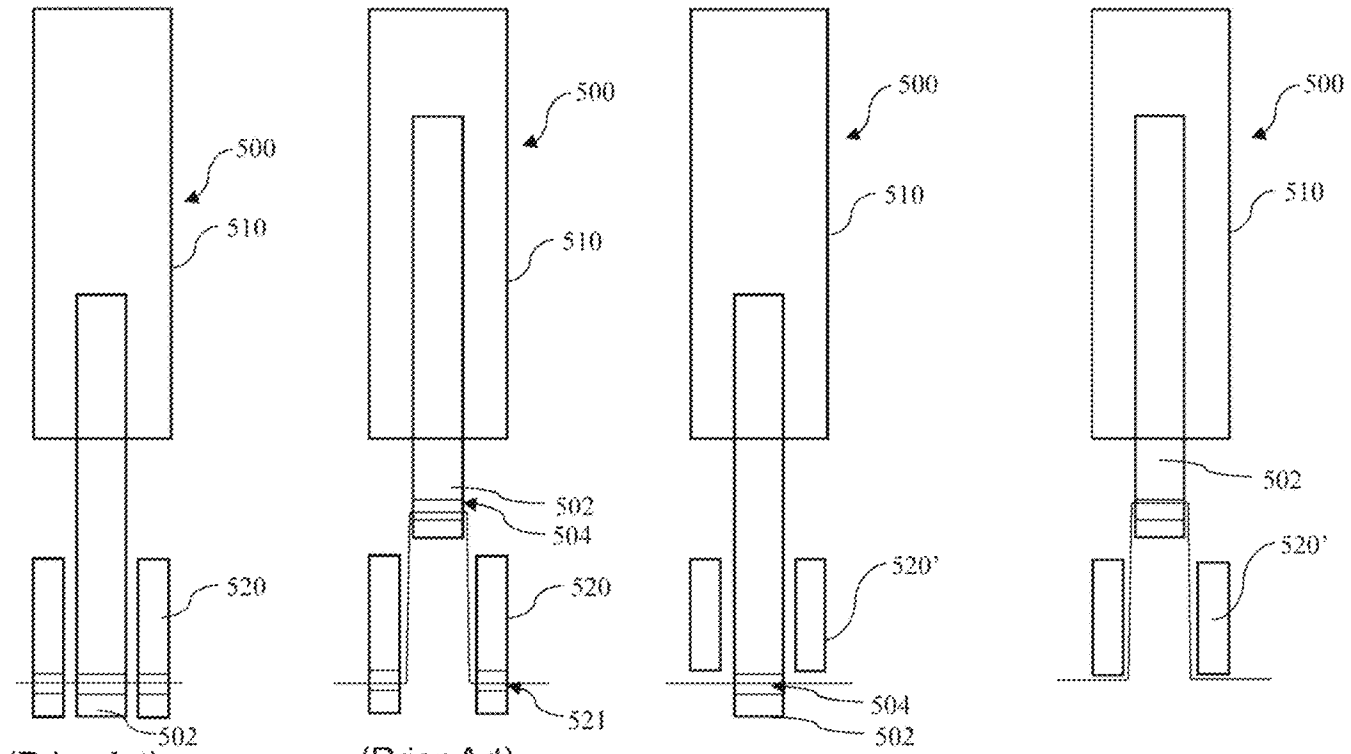
FIG. 6A (Prior Art)
FIG. 6B (Prior Art)
FIG. 6C
FIG. 6D
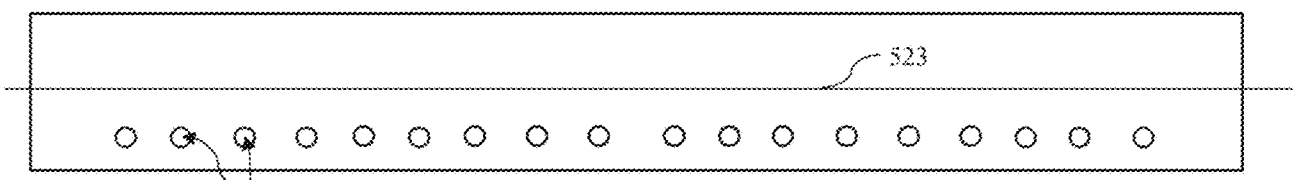
FIG. 7A (Prior Art)

TUFTED ARTICLES, AND SYSTEMS AND METHODS FOR MAKING SAME

CROSS-REFERENCE TO RELATED APPLICATION

This application claims priority to and the benefit of the filing date of U.S. Provisional Patent Application No. 63/598,369, filed Nov. 13, 2023, the entirety of which is incorporated by reference herein.

FIELD

This disclosure relates to systems and methods for forming tufted articles, such as turf, using hollow needle tufting machines.

BACKGROUND

Hollow needle tufting machines can deliver multiple colors or types of yarn to a single tufted article. Conventional hollow needle tufting machines typically include a plurality of yarns that can be held above and fed through a single hollow tufting needle. One known hollow needle tufting machine is disclosed in U.S. Pat. No. 10,961,647, granted Mar. 30, 2021, the entirety of which is hereby incorporated by reference herein for all purposes.

Conventional hollow needle tufting machines are unsuitable for many types of yarn, including staple fiber, wool, turf yarns, large yarns, and yarns that do not include or maintain a yarn twist. Accordingly, conventional hollow needle tufting machines are incapable of forming various types of tufted articles.

SUMMARY

Described herein are various systems and methods for forming tufted articles using a hollow needle tufting machine. The systems and methods can be used for tufting different types of yarns, such as turf yarns, staple yarns, or yarns having a denier greater than 5000.

In one aspect, a system includes a pair of guides. A clevis is movable between the pair of guides. The clevis defines an opening therethrough. Yarn extends through the opening through the clevis. The yarn is configured to contact only exterior surfaces of the pair of guides.

Also disclosed herein is a system including a manifold bar defining a plurality of openings configured to receive a respective yarn. Each opening extends along an axis that meets a vertical axis at an angle of at least 14 degrees.

Also disclosed herein, in one aspect, is method including applying, using a pressure foot injector, a pressure less than 10 psi (e.g., from 1 psi to 10 psi). Optionally, the pressure foot injector does not apply pressure.

Also disclosed herein, in one aspect, is method including applying a first pressure of above 90 psig for feeding or tufting a yarn; applying a second pressure for holding the yarn, wherein the second pressure is lower than the first pressure, wherein the second pressure is above 70 psig; and applying a third pressure to a needle injector of above 90 psig.

Additional advantages of the invention will be set forth in part in the description which follows, and in part will be obvious from the description, or may be learned by practice of the invention. The advantages of the invention will be realized and attained by means of the elements and combinations particularly pointed out in the appended claims. It is to be understood that both the foregoing general description and the following detailed description are exemplary and explanatory only and are not restrictive of the invention, as claimed.

DETAILED DESCRIPTION OF THE FIGURES

These and other features of the preferred embodiments of the invention will become more apparent in the detailed description in which reference is made to the appended drawings wherein:

FIG. 6A is a schematic diagram depicting a jerker of a conventional tufting machine.

FIG. 6B is a schematic diagram depicting the jerker of FIG. 6A is a retracted position. FIG. 6C is a schematic diagram depicting a jerker of an exemplary tufting machine as disclosed herein.

FIG. 6D is a schematic diagram depicting the jerker of FIG. 6C is a retracted position.

FIG. 7A is a schematic view of a guard of a jerker of a conventional tufting machine.

DETAILED DESCRIPTION

Figure 1:
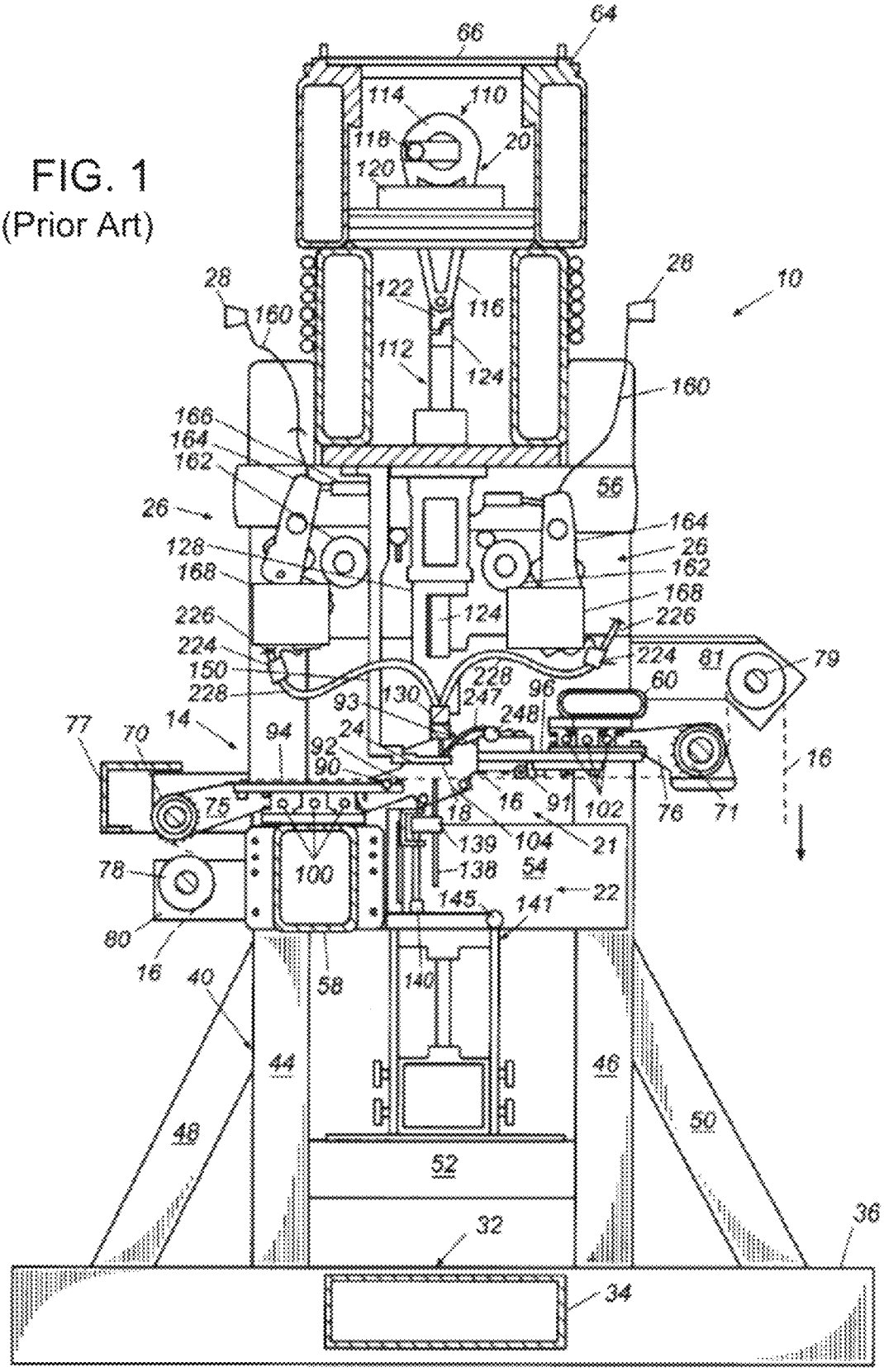
FIG. 1 (Prior Art)
FIG. 1 is a partial sectional elevational view of an exemplary tufting machine as disclosed herein.

The present disclosure can be understood more readily by reference to the following detailed description, examples, drawings, and claims, and their previous and following description. However, before the present devices, systems, and/or methods are disclosed and described, it is to be understood that this disclosure is not limited to the specific devices, systems, and/or methods disclosed unless otherwise specified, as such can, of course, vary. It is also to be understood that the terminology used herein is for the purpose of describing particular aspects only and is not intended to be limiting.

The following description is provided as an enabling teaching of the disclosed articles, systems, and methods in their best, currently known embodiments. To this end, those skilled in the relevant art will recognize and appreciate that many changes can be made to the various aspects of the articles, systems, and methods described herein, while still obtaining the beneficial results of the disclosure. It will also be apparent that some of the desired benefits of the present disclosure can be obtained by selecting some of the features of the present disclosure without utilizing other features. Accordingly, those who work in the art will recognize that many modifications and adaptations to the present disclosure are possible and can even be desirable in certain circumstances and are a part of the present disclosure. Thus, the following description is provided as illustrative of the principles of the present disclosure and not in limitation thereof.

As used throughout, the singular forms "a," "an," and "the" include plural referents unless the context clearly dictates otherwise. Thus, for example, unless the context dictates otherwise, reference to "a needle" provides disclosure of embodiments in which only a single such needle is provided, as well as embodiments in which a plurality of such needles are provided.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint. Optionally, in some aspects, when values are approximated by use of the antecedents "about," "substantially," or "generally," it is contemplated that values within up to 15%, up to 10%, up to 5%, or up to 1% (above or below) of the particularly stated value can be included within the scope of those aspects. In other aspects, when angular values are approximated by use of the antecedents "about," "substantially," or "generally," it is contemplated that angular values within up to 15 degrees, up to 10 degrees, up to 5 degrees, or up to one degree (above or below) of the particularly stated angular value can be included within the scope of those aspects.

As used herein, the terms "optional" or "optionally" mean that the subsequently described event or circumstance may or may not occur, and that the description includes instances where said event or circumstance occurs and instances where it does not.

The term "tuft," as used herein, encompasses both cut yarn stitches and loop yarn stitches, and the term "tufting" encompasses both the act of forming a cut yarn stitch and the act of forming a loop yarn stitch.

The terms "fiber" and "yarn" as used herein refer to a continuous strand or bundle of filaments. The filaments can include, for example, ribbons (e.g., slit films). Thus, such fibers and yarns can include, for example and without limitation, tape ribbons, monofilament yarns, cut yarns, looped yarns, fibrillated yarns, multifilament yarns, twisted yarns (e.g., twisted staple yarns), wrapped yarns, staple yarns, and the like. Optionally, consistent with the use of the terms "fiber" and "yarn", the continuous strand or bundles of fibers can be cut to form cut fibers or cut yarns. Optionally, fibers/yarns can be textured using conventional methods. "Fibers" and "yarns" as disclosed herein are capable of being independently delivered to a backing structure (for example, via tufting). A yarn or a fiber can be a single end fiber (single ply yarn) or a multiple end fiber (e.g., a plied yarn) that includes a plurality of single end fibers that are entangled or otherwise commingled with one another (for example, by air entanglement, twisting, wrapping, and the like) such that the single end yarns are no longer individually or independently moveable. For example, a plurality of single end yarns can be twisted together to form a plied yarn (e.g., a two-ply yarn can include two single end yarns that are twisted together). Each single end yarn/fiber can be formed from at least one filament (optionally, a plurality of filaments). Thus, within a multiple end yarn, each single end yarn that makes up the multiple end yarn can include a respective filament or plurality of filaments.

As used herein, the term "denier" refers to the weight in grams of 9,000 meters of yarn. "Denier per filament" refers to the denier (weight in grams of 9,000 meters) of a single filament of a yarn. When the yarn consists of a single end yarn, the "total denier" of the yarn can refer to the combined denier (i.e., the sum of the respective deniers) of all filaments of the single end yarn. When the yarn includes a plurality of yarn ends (a plurality of single end yarns) that are entangled or otherwise commingled with one another such that the yarn ends are no longer individually or independently moveable, then the "total denier" of the yarn can refer to the combined denier (i.e., the sum of the respective deniers) of the plurality of yarn ends (the plurality of single end yarns that define the multiple end yarn).

The total denier, denier per filament (dpf), and ply information can be used to determine the number of filaments within a given yarn. As a first example, a single-ply yarn can be identified as a 6000 total denier, 4 dpf yarn. This indicates that the single-ply yarn has a total denier of 6000, and that each filament of the single-ply yarn has a denier (per filament) of 4. The total number of filaments can be determined by dividing the total denier (6000) by the dpf (4), producing a result of 1500 filaments within the yarn. Rather than identifying the yarn as a 6000 total denier, 4 dpf yarn, it is contemplated that the yarn can instead be identified as a 6000/1500 filament yarn (with the dpf (4) being determined by dividing the total denier (6000) by the number of filaments (1500)).

As another example, consider a two-ply yarn that has the same total denier (6000) but is formed by twisting or otherwise commingling two of the same single-end yarns. Such a yarn can be identified as a 3000×2 yarn, which indicates that the yarn is a two-ply yarn, with each ply corresponding to a single-end yarn having a total denier of 3000. If the dpf of each of the single-end yarns is 15, then the number of filaments of each of the single-end yarns can be calculated by dividing the total denier (3000) by the dpf (15), producing a result of 200 filaments within each of the single-end yarns. Therefore, the total number of filaments within the two-ply yarn can be determined to be 600 (the sum of the number of filaments within the two single-end yarns that make up the two-ply yarn).

In yet another example, consider a yarn formed by twisting or otherwise commingling two different single-end yarns to form a yarn bundle. The yarn bundle can include a first single-end yarn that is a 3000 total denier, 15 dpf yarn and a second single-end yarn that is a 3000 total denier, 4 dpf yarn. This indicates that the first single-end yarn has a total denier of 3000, with each filament of the yarn having a denier (per filament) of 15. The second single-end yarn has a total denier of 3000, with each filament of the yarn having a denier (per filament) of 4. Thus, the first single-end yarn has 200 filaments (with each filament having a denier of 15 to provide a total denier of 3000), while the second single-end yarn has 750 filaments (with each filament having a denier of 4 to provide a total denier of 3000).

Referring now to the drawings, in which like reference characters indicate like parts throughout the several views, disclosed herein are hollow needle tufting machines that are, or can be, configured to form tufted articles from yarns including, but not limited to, turf yarns, staple fiber, wool, large yarns (e.g., greater than 5000 denier), and yarns that do not include or maintain a yarn twist. Also disclosed herein are methods of forming tufted articles using hollow needle tufting machines and articles formed using hollow needle tufting machines.

The Tufting Machine

An exemplary tufting apparatus 10 is shown in FIG. 1. As shown, the tufting apparatus 10 can comprise a tufting frame 12 supporting a backing transport system 14 for directing a backing 16 through the tufting apparatus, a row of needles 18 mounted to a yarn applicator 20 for implanting tufts of yarn in the backing at a yarn applying region 21, a yarn cutting system 22 for cutting the yarn as it is implanted, presser feet 24, a yarn feed mechanism 26 for supplying continuous lengths of yarn from a yarn supply 28, such as a creel (not shown) to the needles, and a control system 30 for controlling the operation of the tufting apparatus so as to produce a patterned tufted product in accordance with a preselected pattern. The length of the tufting apparatus 10, the spacing of the needles 18, and the number of needles in the apparatus can vary considerably depending on the product to be produced and the desired rate of production. Such a tufting apparatus is described in more detail in U.S. Pat. No. 6,293,211, which is incorporated by reference herein in its entirety. In some aspects, the tufting apparatus can have only a single row of needles 18. In other aspects, the tufting apparatus can have a plurality of rows of needles 18.

The Frame

An exemplary frame 12 of the tufting apparatus 10 is shown in FIG. 1 and can comprise a horizontal I-shaped base frame 32, which can include an elongate member 34 extending perpendicularly between end members 36. Vertical end frames 40 can extend upwardly from the end members 36. Each of the end frames 40 can comprise a pair of spaced vertical members 44 and 46, angled support bars 48 and 50 extending between the vertical members and the respective end members 36. In each of the end frames 40, a cutter system frame support bar 52, a backing frame support bar 54, and an upper frame support bar 56 can be spaced from one another and extend between the vertical members 36. A transverse backing support beam 58 can extend between the vertical end frames 40 proximate the backing inlet side 59 of the tufting apparatus 10. Another transverse support beam 60 can extend between the vertical end frames 40 at the exit side 61 of the tufting apparatus 10. Respective end panels 62 can extend between the spaced vertical members 44 and 46 and between the backing frame and upper frame support bars 54 and 56 for supporting various components as described hereinbelow. A plurality of spaced vertical support bars (not shown) can extend vertically between the transverse support beam 60 and elongate main drive housing 64. The main drive housing 64 can extend between the vertical end frames 40 and is mounted on top of the upper frame support bars 56. The interior of the main drive housing 64 can be accessible through removable access panels 66 on top of the main drive housing.

The Backing Transport System

The backing transport system 14 can transport the backing 16 through the tufting apparatus 10 while the reciprocating hollow needles 18 implant tufts of yarn in the backing at the yarn applying region 21. The backing can be in the form of a continuous running web. The backing 16 can move in the direction of the arrow in FIG. 1 and the area through which the backing passes through the tufting apparatus 10 is the yarn applying region 21.

As shown in FIG. 1, the backing transport system 14 can have a roll assembly comprising an entry pin roller 70 and an exit pin roller 71 which are driven by respective electric motors (not shown). The motors can maintain the backing 16 under tension as the backing passes the reciprocating needles 18. The exit pin roller motor can control the tension of the backing 16 and the entry pin roller motor can control the velocity of the backing. The pin rollers 70 and 71 can be mounted to the frame 12 and extend between respective brackets 75 and 76. A guard assembly 77 can be mounted to the frame 12 and extend alongside the entry pin roller 70 to shield the entry pin roller. The backing transport system 14 can further comprise a pair of guide rollers 78 and 79 which cooperate with the pin rollers 70 and 71, respectively, to guide the backing 16. The guide rollers 78 and 79 can be mounted to the frame 12 and extend between respective brackets 80 and 81. The pin roller motors can be connected to the pin rollers 70 and 71 with couplings.

A second pair of pin rollers 90 and 91, which have smaller diameters than the entry and exit pin rollers 70 and 71, can be located closely adjacent to reciprocating needles 18 on the opposite sides of the backing 16. These additional pin rollers 90 and 91 can provide better control of the backing 16 in the area adjacent to where the yarn tufts are implanted. The smaller pin rollers 90 and 91 can be carried on respective brackets 92 and 93.

The backing transport system 14 can further comprise at least one bedplate (e.g., a pair of bed plates 94 and 96) for supporting the backing 16 as the backing moves through the tufting apparatus 10. One of the bed plates 94 can be positioned below the backing 16 and upstream of the reciprocating needles 18 between the reciprocating needles and the entry pin roller 70. The other of the bed plates 96 can be positioned above the backing 16 and downstream of the reciprocating needles 18 between the reciprocating needles and the exit pin roller 71. The at least one bed plate (e.g., bed plates 94 and 96) can be transversely shiftable relative to the backing advance direction.

Each of the bed plates 94 and 96 can be carried on a pair of transversely extending rods 100 and 102 affixed to the frame 12. The bed plates 94 and 96 can be connected at each end by respective connecting members 104 and 105. Optionally, the entry and exit pin rollers 70 and 71 can be carried by the shiftable bed plates 94 and 96, respectively. The connecting members 104 and 105 can be connected to at least one electric motor (not shown) with at least one commercially available ball screw drive. The ball screw drive can be capable of producing very small and precisely controlled transverse movements when rotated by the motor. Specifically, this precision mechanism can enable precisely controlled incremental movements of the order of a half inch to one-tenth of an inch or less. The motor and the ball screw drive can shift the bed plates 94 and 96, as well as the pin rollers 70 and 71, transversely toward the longitudinal direction of advancement of the backing which produces a corresponding transverse shifting movement of the backing 16 so that each needle 18 may insert yarn into the backing at a number of transverse locations. The guide rollers 78 and 79 can also be shifted transversely in substantial correspondence with the pin rollers 70 and 71 by a second, less precise shifting mechanism.

The Needle Actuation Assembly

The needle actuation assembly 20 can reciprocate the needles 18 by adjustable cam assemblies 110 which are coupled to the needles by respective link assemblies 112. The adjustable cam assemblies 110 are shown in FIG. 1 and can comprise a circular cam lobe member 114 rotatably supported by bearings within a circular portion of a yoke member 116. The cam lobe members 114 can be carried on and driven by a transversely extending rotatable shaft 118 which is offset from the center of each cam lobe member and preferably supported by bearings on a bearing support 120. The link assemblies 112 can comprise a coupling link 122 which is pivotally connected to a yoke member 116 and connected to a vertically extending push rod 124. Each vertically extending push rod 124 can extend through and can serve as a guide for vertically reciprocal movement by bearings 126 mounted to the bottom of the main drive housing 64.

Figure 2:
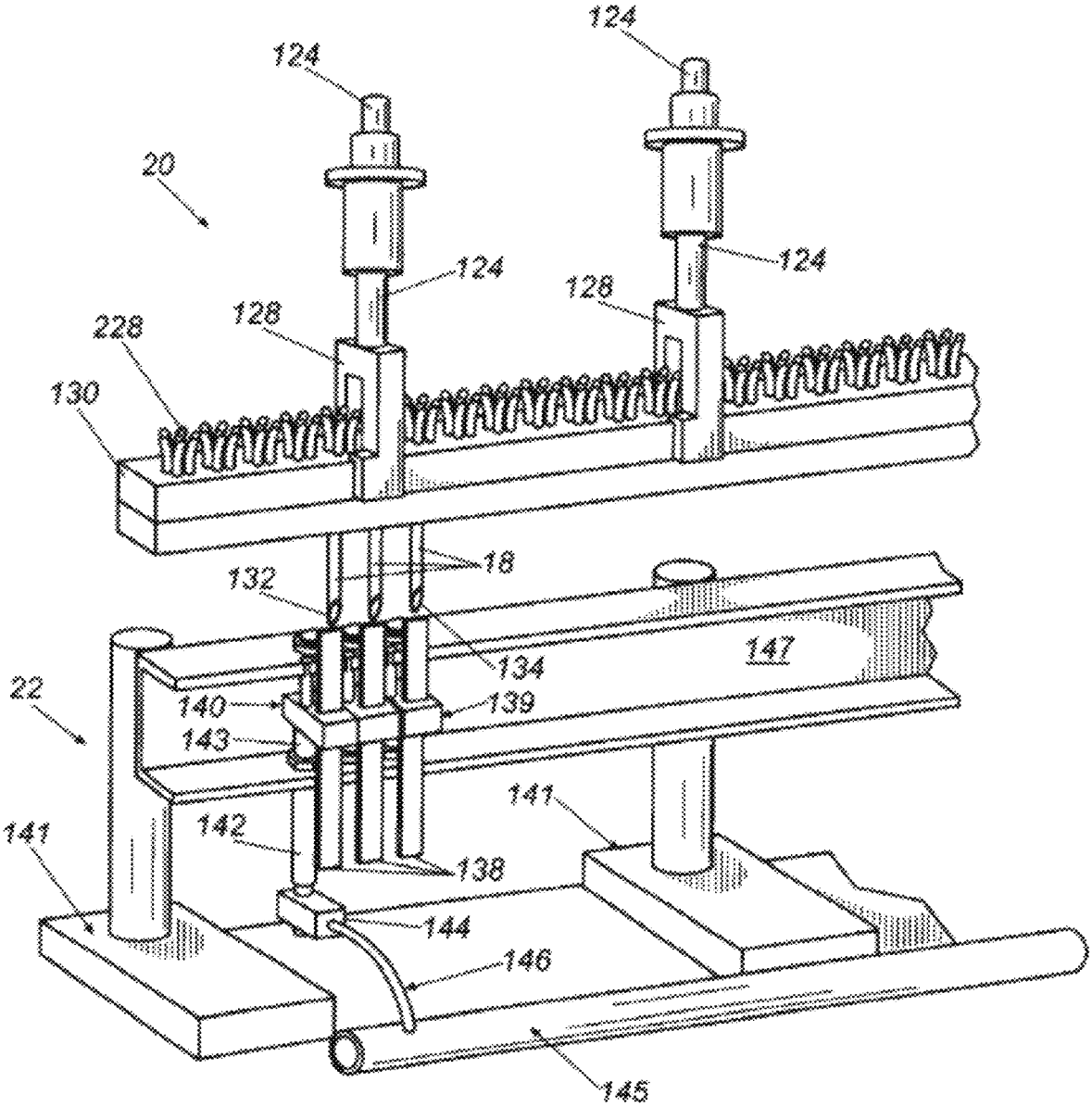
FIG. 2 (Prior Art)
FIG. 2 is a partial perspective view of an exemplary needle actuation assembly and an exemplary yarn cutting assembly as disclosed herein.

As best shown in FIG. 2, the lower ends of the push rods 124 can be connected to respective mounting blocks 128 which are, in turn, can be connected to a transversely extending needle mounting bar 130, which is also referred to as a yarn exchanger. The needles 18 can be mounted to the mounting bars 130. In FIG. 1, only one needle 18 is illustrated, but it should be understood that a plurality of needles 18 can extend along the length of the needle mounting bar 130. Upon rotation of the shaft 118, the adjustable cam assemblies 110 can rotate to impart a reciprocating movement to the yoke members 116 and, in turn, a similar movement to the needles 18 via the link assemblies 112 to cause the needles to repetitively penetrate and withdraw from the backing 16.

Many turf yarns have the tendency to twist together while tufting, moving, or being fed, with adjacent yarns in this area positioned between the creel header and yarn feed mechanisms. In some aspects, the tufting machine can comprise tubing that guides respective yarns to the yarn exchanger. For example, the tufting machine can comprise a header, and the tubing can extend from the header to the yarn exchanger. In some aspects, tubing can extend beyond all conventional yarn guides and pneumatic componentry (e.g., to a lowest point possible, just before the yarn feed mechanisms), to eliminate the possibility of the yarns mixing or entanglements between the existing creel header and yarn feed mechanisms, while tufting (which requires a machine stoppage to fix). That is, the tubing can inhibit undesired twisting or other interactions between yarns.

The needle mounting bar 130 can be rectangular in cross-section, and for each needle 18, can have a central passage (not shown) extending from an inlet at the top of the mounting bar to a funnel (e.g., provided in a funnel block 19 (FIG. 9)) and a plurality of yarn passages (not shown) surrounding each central passage and extending from respective inlets in the top of the mounting bar to the funnel. Each funnel extends from an inlet to an outlet at the bottom of the mounting bar. Such an arrangement is illustrated in detail in U.S. Pat. No. 5,165,352, which is incorporated herein by reference in its entirety.

In various aspects, the funnel block can comprise channeling therein to segregate (or otherwise provide spacing between) yarns within the block. The channeling can inhibit yarns within the funnel block from mixing or becoming entangled.

The needles 18 can each have a hollow passage extending from an inlet to an outlet 132 at a tip 134, which can optionally be an angled pointed tip. An exemplary structure of the needles is disclosed in more detail in U.S. Pat. No. 4,991,523, which is incorporated by reference herein in its entirety. Each needle 18 can be disposed such that the inlet of the needle is in communication with the outlet of the respective funnel.

The needle actuation assembly 20 can be driven by electric motors (not shown) operatively connected to opposite ends of the main drive shaft 118 and mounted to opposite ends of the main drive housing 64 for rotating the main drive shaft. For high product throughput, the main drive motors can rotate the main drive shaft 118 at speeds up to about 1000 rpm.

Each rotation of the main drive shaft 118 can cause the needles 18 to penetrate and then withdraw from the backing 16. In other words, each rotation of the main drive shaft 118 can cause one needle reciprocation cycle, also referred to as a tufting cycle, which includes a downstroke and an upstroke of the needles 18.

During each tufting cycle, the hollow needles 18 of the yard applicator 20 can reciprocate between a top position and a bottom position. The backing can be is positioned between the top position and the bottom position of the tufting cycle. In one cycle, the tip 134 of each hollow needle 18 can travel from the top position to the bottom position and back to the top position. Between the top position and the bottom position, the hollow needle 18 can penetrate the backing 16 and implant a yard tuft therein. The movement of the hollow needle 18 between the top position and the bottom position is the downstroke of the cycle, and the movement of the needles from the bottom position to the top position is the upstroke of the cycle.

Yarn Cutting Assembly

As shown in FIGS. 1 and 2, the yarn cutting assembly 22 can be positioned below the backing transport system 14 and comprise at least one knife blade 138 (optionally, a plurality of knife blades 138), with one knife blade positioned below each of the needles 18 for cutting the yarn implanted into the backing 16 by the needle at the downstroke of each tufting cycle. The knife blades 138 can be arranged to cooperate with the needles 18 by sliding over the respective tips of the needles 18 in a shearing-like action to cut the yarn that is ejected from the needles. The yarn cutting assembly 22 can further comprise a blade holder 139, a mechanism 140 for reciprocating the knife blade 138, and a frame 141 for supporting the knife blade, blade holder, and reciprocating mechanism.

The reciprocation mechanism 140 for each blade 138 can comprise an air cylinder 142 for driving a shaft 143 in a vertical reciprocating motion and an air solenoid 144 for activating the air cylinder. A pressurized air supply pipe 145 can supply air to the air cylinder 142 as shown in FIG. 2. Tubes 146 can supply the pressurized air supply pipe 145 with pressurized air from a source of pressurized air.

The knife blades 138, blade holders 139, and reciprocating mechanisms 140 can be mounted to the cutting system frame 141 along a transverse C-bar 147. As will be explained in more detail below, each of the knife blades 138 can be individually controlled and can be individually reciprocated independent of the other so that on any penetration by any needle 18, the respective knife blade 138 can be positioned to form a cut tuft or form a loop tuft.

The reciprocating mechanisms 140 can move the knife blades 138 and blade holders 139 up and down synchronous with the reciprocating movements of the hollow needles 18.

The knife blades 138 can reciprocate between a bottom position and a top position. Each stroke of the knife blades 138 can include an upstroke from the bottom position to the top position and a downstroke from the top position to the bottom position. In the top position, the knife blades 138 can engage respective hollow needles 18 and cut the yarn. The structure of an exemplary yarn cutting assembly 22 is disclosed in more detail in U.S. Pat. No. 5,588,383, which is incorporated by reference herein in its entirety.

An Alternative Yarn Cutting Assembly

Figure 4:
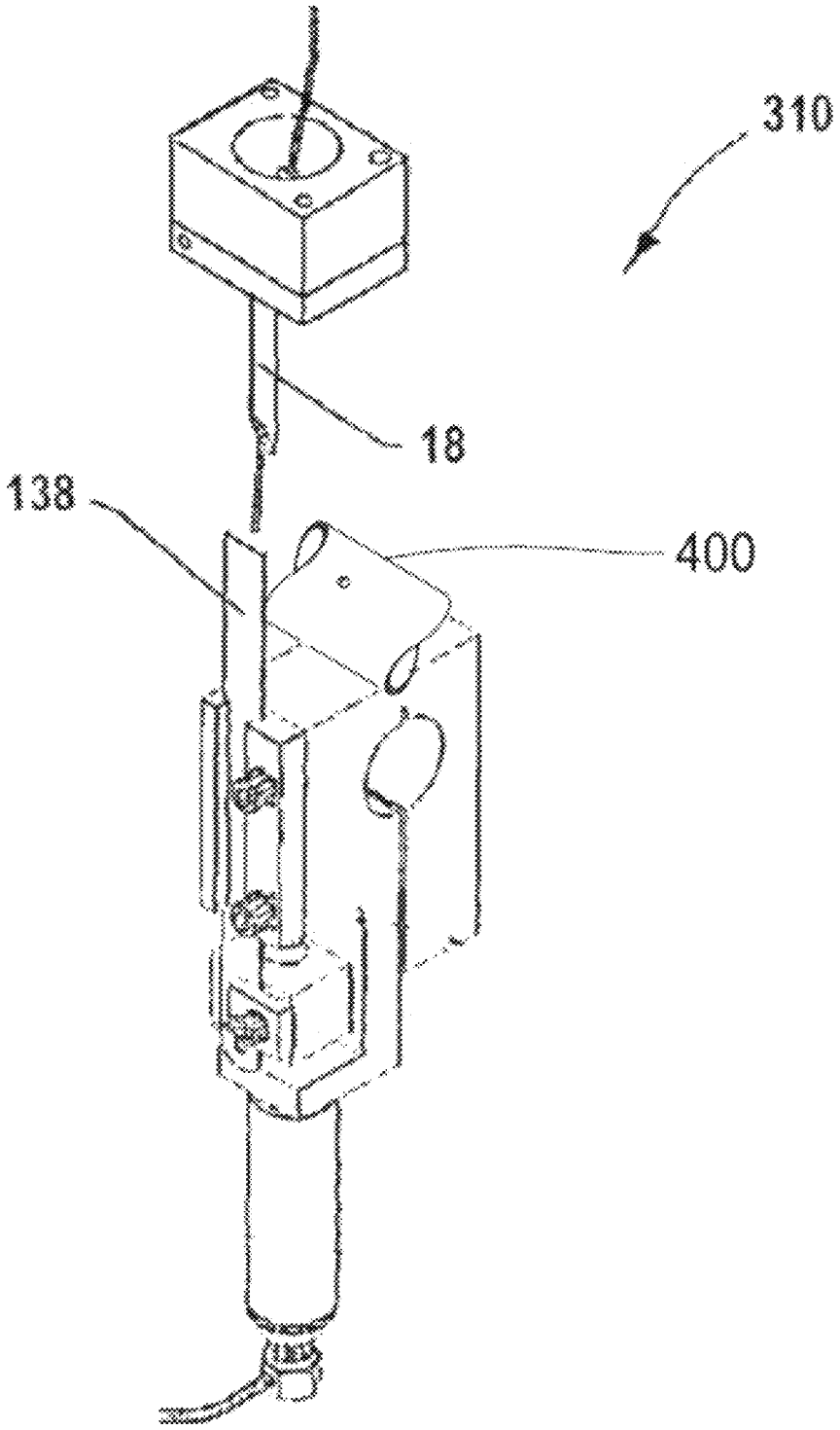
(Prior Art) FIG. 4
FIG. 4 is a perspective view of an exemplary knife system and an isolated portion of an exemplary air delivery assembly as disclosed herein. As shown, the air delivery assembly can selectively displace portions of yarn tufts to prevent cutting of yarn tufts by the knife system.

An alternative yarn cutting assembly is generally described in U.S. Pat. No. 7,831,331, which is incorporated herein by reference in its entirety. Referring now to FIG. 4, a perspective view of an exemplary knife system 310 is provided. The knife system 310 can include a knife 138. While FIG. 4 illustrates only a single grounded needle 18, it is contemplated that the knife system can be provided with more than one needle. In addition, while FIG. 4 illustrates the needle 18 receiving only a single strand of yarn, it is contemplated that the needle can receive more than one strand of yarn.

As shown in FIG. 4 and referenced above, the knife 138 of the knife system 310 can be adapted to be moved between a cutting position and a non-cutting position. More particularly, the knife 138 can be adapted to be moved into a position in which its distal end is nearest to the distal end of needle 18, i.e., the cutting position. Preferably, when the knife is in the cutting position, it can make contact with the needle 18 when the needle is moved to its penetrating position. Conversely, when the knife 138 is moved into a position in which its distal end is farthest from the distal end of needle 18, i.e., the non-cutting position, the knife will not make contact with the needle 18 or will not make sufficient contact to effect cutting, even when the needle is moved to its penetrating position.

While FIG. 4 illustrates only a single knife 138, it is contemplated that the knife system can include more than one knife. It is further contemplated that the knife or knives can be of any suitable configuration adapted to cut the yarn received by the needle or needles.

Figure 5:
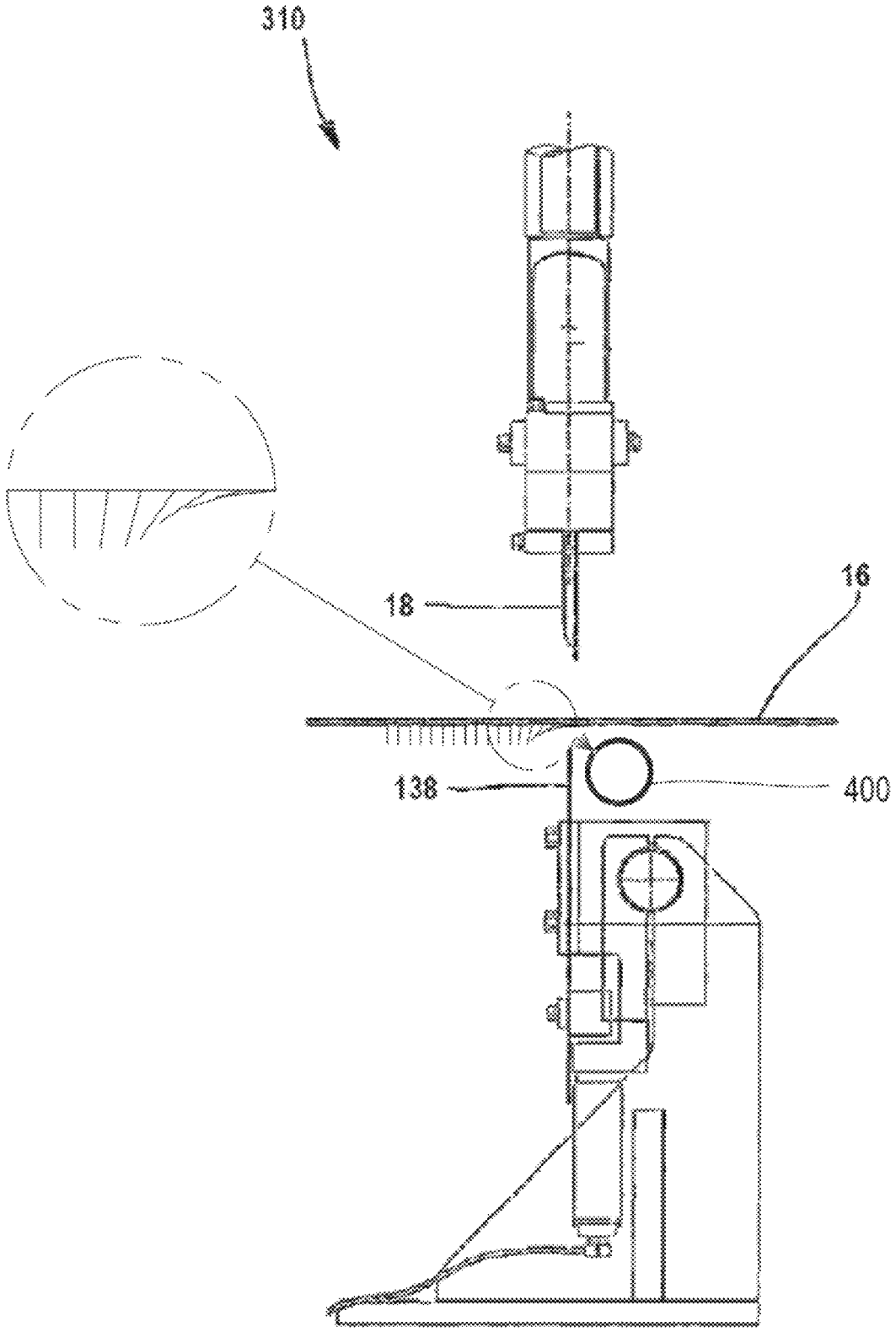
(Prior Art) FIG. 5
FIG. 5 is an end view of the knife system and air delivery assembly of FIG. 4.

Referring now to FIG. 5, an end view of knife system 310 is illustrated. As shown in FIG. 5, the knife system 310 can include needle 18 and knife 138. As can be appreciated from FIG. 5, the needle 18 can be adapted to move between a non-penetrating position (as shown) in which the needle is not in contact with backing 16 of tufted floor covering and a penetrating position (not shown) in which the distal end of the needle penetrates the backing. As can also be appreciated from FIG. 5, when the knife is moved into a position in which its distal end is nearest to the distal end of needle 18, i.e., the cutting position, the knife can make contact with the needle when the needle is moved to its penetrating position. Conversely, when the knife is moved into a position in which its distal end is farthest from the distal end of needle 138, i.e., the non-cutting position, the knife will not make not make contact or will not make sufficient contact with the needle to cut a tuft when the needle is moved to its penetrating position. The needle 18 can be adapted to be moved between the penetrating position and the non-penetrating position by a rotating drive shaft or any other suitable means, The Presser Feet Optionally, to prevent the needles 18 from raising the backing 16 when the needles are removed from the backing during the upstroke of the yarn applicator 20, a plurality of presser feet 24 can be disposed adjacent the needles transversely across the tufting apparatus 10 and slightly above the backing. The presser feet 24 can be connected to an elongated rail member 150, shown in FIG. 1, with means such as screws. The rail member 150 can be connected to the underside of the main drive housing 64 with arms 152 to fix the presser feet 24 to the tufting apparatus frame 12.

Each of the presser feet 24 can extend below the needles 18 and have a plurality of bores corresponding to each needle and through which the respective needles may reciprocate freely.

Air conduits 248 can communicate with each of the needle bores. Pressurized air of pressure foot injectors can be blown through the conduits 248 by corresponding tubes 155 connected to a pressurized air pipe 156. Pressurized air can be directed through the conduits 248 and into the needle bores as the needles 18 are withdrawn from the backing 16. This air can force the severed limb of yarn, which is the limb forming the last backstitch and which is no longer connected to the needle, down into the opening in the backing before the needle makes a subsequent opening. This can eliminate the excess yarn on the rear of the backing and preclude the yarn from forming a backstitch raised above the surface of the backing material. Optionally, each air conduit 248 can be disposed at an angle of about 45° relative to the axis of the respective needle 18. Exemplary presser feet 154 are disclosed in U.S. Pat. No. 5,158,027, the disclosure of which is incorporated by reference herein in its entirety.

With conventional use of hollow needle tufting machines, the presser feet usually require from 60 psi to 80 psi of pressurized air blown through the conduits 248. An absolute minimum pressure is about 20 psi to about 30 psi. Unlike conventional use of hollow needle tufting machines, in some aspects, it can be advantageous to limit, minimize, or eliminate air pressure applied at the presser feet. For example, in some aspects, the pressure foot injectors of the tufting machine can apply less than 20 psi to the yarn. In further aspects, the pressure foot injectors can apply less than 15 psi to the yarn (e.g., from about 1 psi to about 15 psi), or less than 10 psi to the yarn (e.g., from about 1 psi to about 10 psi), or less than 5 psi to the yarn (e.g., from about 1 psi to about 5 psi). In further exemplary aspects, the pressure foot injectors can apply less than 1 psi (e.g., above zero but less than 1 psi) or zero pressure to the yarn.

In further aspects, the air foot injector can be omitted. For example, yarn pullers can be used to drive yarns into the air manifold blocks and yarn conduits.

The Yarn Feed Assembly

The tufting apparatus 10 can supply at least one yarn (e.g., a plurality of different yarns) to each needle 18 of the tufting apparatus. The yarns can be of different colors so that the tufting apparatus 10 can be used to make multicolor patterned tufted goods such as carpet or turf. Optionally, as further disclosed herein, it is contemplated that the tufting apparatus can have only a single hollow needle 18. In other aspects, it is contemplated that the tufting apparatus 10 can have a plurality of needles spaced apart. The particular number of needles depends on the product to be produced and the level of throughput desired. The tufting apparatus 10 is capable of selecting, for any given needle 18, on any given needle reciprocation cycle, one yarn of a plurality of different yarns and delivering the desired length of that yarn to the respective needle. In addition, the tufting apparatus is capable of simultaneously withdrawing one yarn from a needle 18 and inserting another yarn into that needle in the same needle reciprocation cycle. Thus, in use, it is contemplated that the disclosed tufting apparatus 10 can permit different yarns to be delivered to the same needle during sequential needle reciprocation cycles (i.e., with a first yarn being delivered to a particular needle during a first reciprocation cycle and a second yarn being delivered to the same needle during a second reciprocation cycle that immediately follows the first reciprocation cycle).

Yarn can be supplied to the tufting apparatus 10 through overhead tubes from a creel (not shown). The creel generally comprises a frame for holding a plurality of yarn spools. The structure and function of such creels is well known to those skilled in the art and is not discussed herein in detail.

At least one yarn feed assembly 26 can be disposed adjacent the push rod 124 of the yarn cutting system 22 and extend between the vertical end frames 40 of the tufting frame 12 along the inlet and exit sides 59 and 61 of the tufting apparatus. The yarn feed assemblies 26 on each side of the tufting apparatus 10 can identical to each other, but in reverse image. Each yarn feed assembly 26 can comprise a driven roller 162 extending between end panel 62 of the vertical end frames 40. In addition, each yarn feed assembly 26 can include a yarn feeder 164 which is driven by the driven roller 162, and an actuator 166 pivotally connected to the yarn feeder for pivoting the yarn feeder. Accordingly, there can be several yarn feeders 164 and actuators 166 associated with each tufting needle 18. In exemplary aspects, the yarn feed assembly 26 can comprise a yarn cylinder 168 as further disclosed herein.

Each driven roller 162 can be concentrically mounted about a drive shaft which extends the length of the tufting apparatus 10. Each drive shaft can be independently driven by respective electric motors (not shown). Therefore, each driven roller can be rotated at different speeds allowing for different yarn feed rates. As is known in the art, this can allow for tufts of different pile height in the same tufted good.

Each yarn feeder actuator 166 can move the respective yarn feeder 164 into and out of peripheral engagement with the respective driven roller 162. Suitable actuators can include a pneumatic cylinder and other reciprocating devices such as an electric solenoid or a hydraulic actuator.

Optionally, a manifold bar 224 (also referred to as a manifold block) can extend between the vertical end frames 40 of the tufting frame 12 and receive the yarn 160 from each of the yarn feeders 164 along the length of tufting apparatus. In some aspects, the manifold bar 224 can be stationary. In other aspects, the manifold bar 224 can be configured to reciprocate. The manifold bar 224 can have a plurality of passageways 225 (FIG. 8) through which the yarns 160 pass. These passageways 225 can lead the yarns to respective flexible yarn delivery tubes 228 which extend from the manifold bar 224 to respective yarn passageways in the needle mounting bar 130. In addition, the manifold bar 224 can include a plurality of respective pressurized air conduits 226 for receiving pressurized air and directing it through the yarn passageways and the manifold bar and flexible yarn delivery tubes 228 to force the yarns 160 through the respective yarn delivery tubes, through the passageways in the needle mounting bar and through the hollow needles 18.

Figure 8:
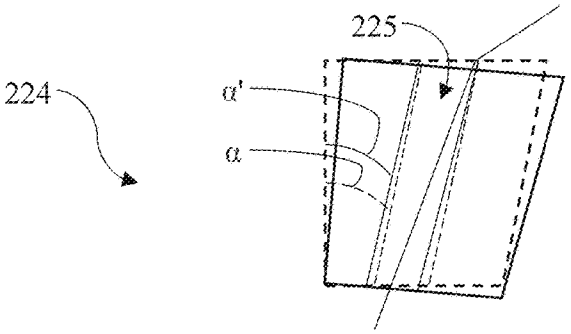
FIG. 8 is a schematic side view of a manifold bar showing the difference between an inlet of a conventional manifold bar (broken lines) and an inlet of an exemplary manifold bar for use with turf yarn or other types of yarn (solid lines).

Conventionally, with reference to FIG. 8, a manifold bar has yarn inlet ports (broken lines) that forms an angle (a) of approximately 10 degrees relative to a vertical axis. The yarn extends to the manifold bar at an angle of much greater than 10 degrees relative to the vertical axis, so the yarn slides against the manifold block as the yarn extends through the opening, as illustrated in FIG. 8. Angling the inlet port toward the angle of the yarn decreases yarn drag and friction as the yarn enters the manifold bar. Said drag and friction can lead to yarn flow stopping during the tufting process. Therefore, the 10-degree inlet port angle tends to help prevent yarn drooping after the jerker and just before the manifold bar (from resultant yarn friction and drag at the manifold bar) that can lead to the yarn flow stopping during the tufting process and a subsequent machine stop for the machine operator to take corrective action. When using turf yarns, the manifold bar can have yarn inlet ports (solid lines) extending along an axis that forms an angle ($\alpha'$) of at least 12 degrees relative to the vertical axis. For example, the manifold bar 224 can have yarn inlet ports extending along respective axes that that form an angle ($\alpha'$) of at least 14 degrees, or from about 14 degrees to about 20 degrees, or from 12 degrees to 30 degrees with the vertical axis. In this way, friction can be reduced to prevent drooping of the turf yarn. In some aspects, the manifold block can be mounted against a surface that is angularly offset from a vertical axis (e.g., by the difference between a' and a) to provide the desired angle of the yarn inlet ports.

Figure 11:
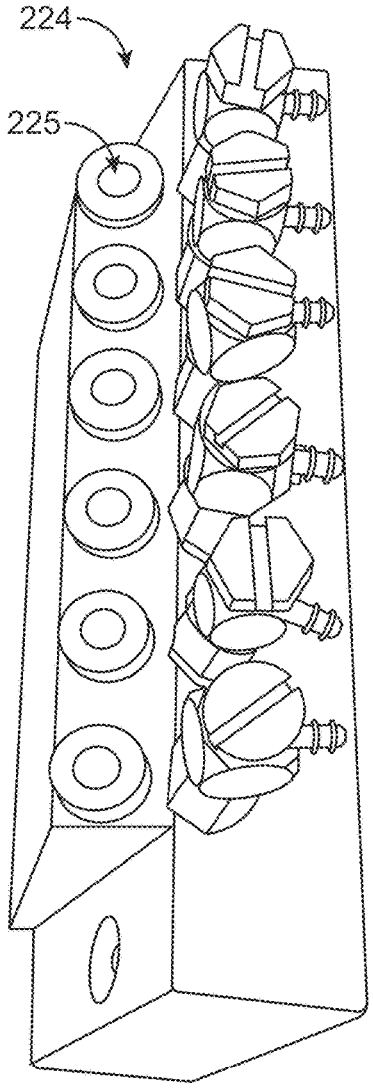
FIG. 11 is a perspective view of a manifold bar having eyelets within its passageways.
Figure 12:
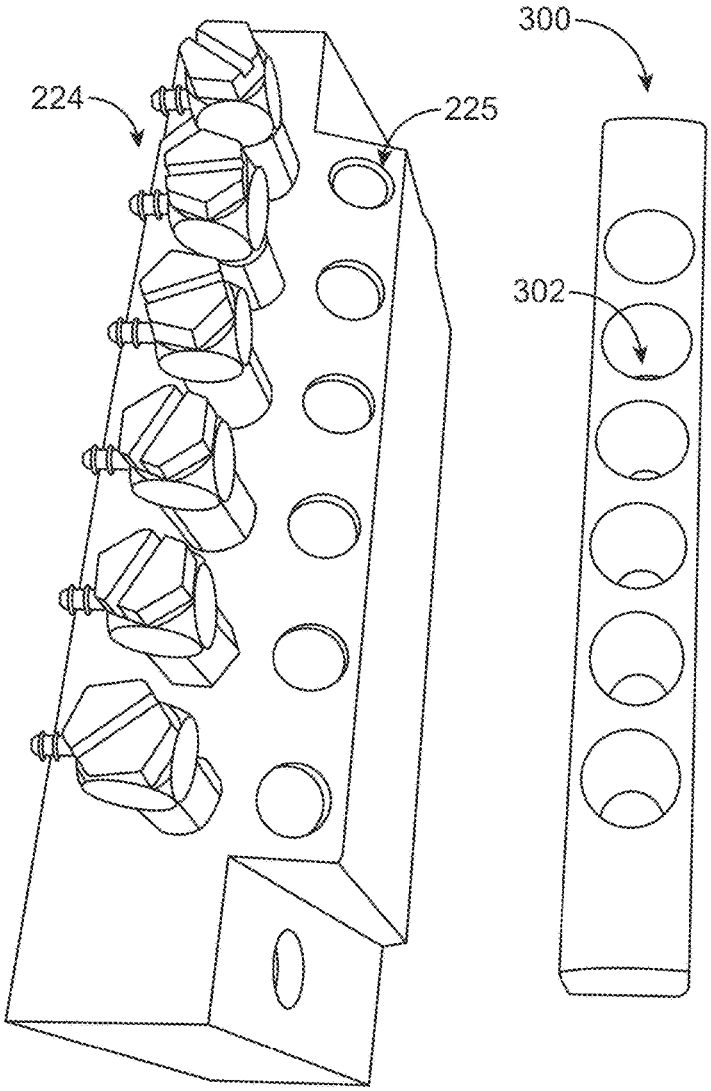
FIG. 12 is a perspective view of the manifold bar of FIG. 11 without eyelets and a guide block for guiding yarns into the passageways of the manifold bar.
Figure 13:
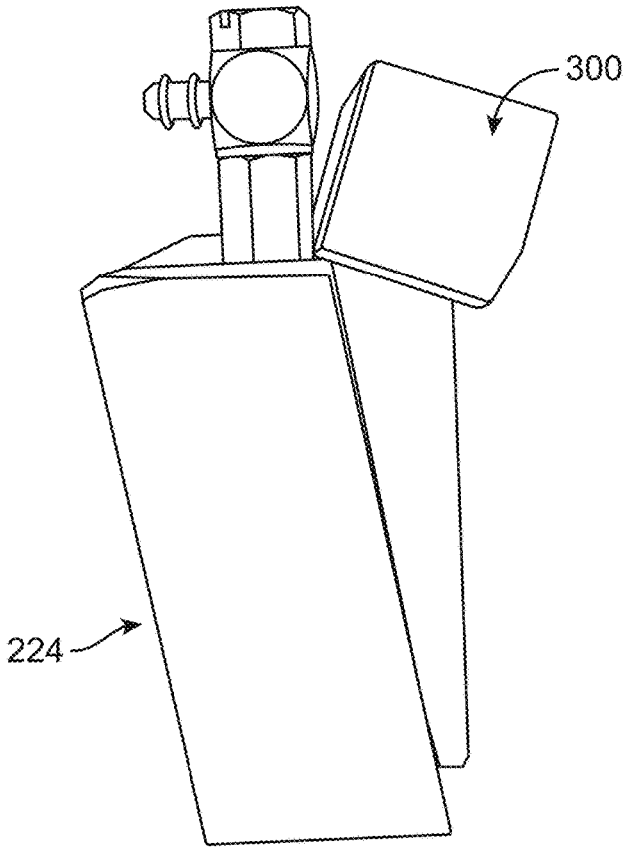
FIG. 13 is a side view of the manifold bar with the guide block of FIG. 12 mounted thereto.
Figure 14:
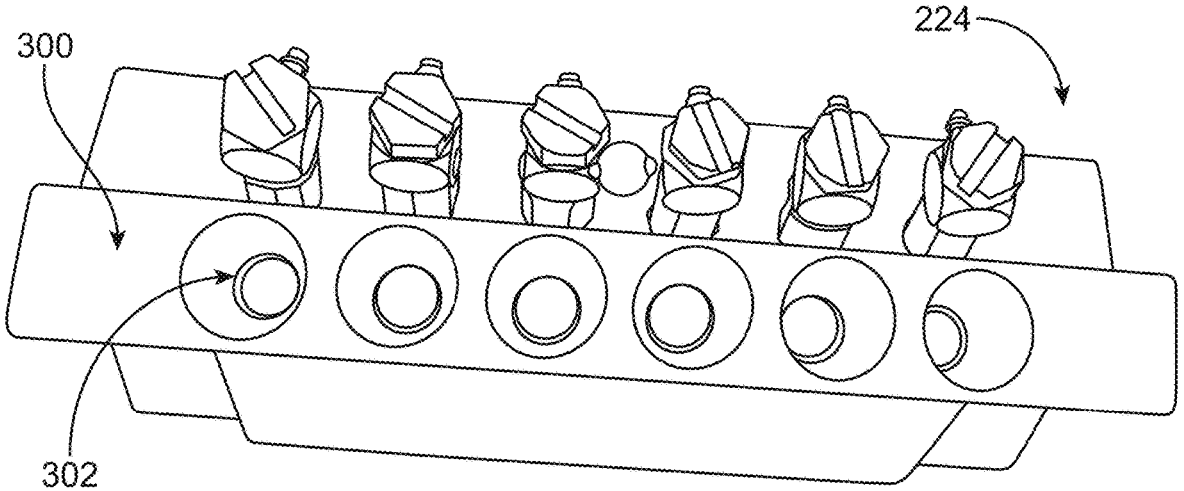
FIG. 14 is a top view of the manifold bar with the guide block of FIG. 12 mounted thereto.

Referring to FIG. 11, the manifold bar 224 can have eyelets provided within the plurality of passageways 225. Referring to FIGS. 12-14, the eyelets can be omitted. For example, a guide block 300 can extend across a plurality of the passageways 225. Optionally, the guide block 300 can be mounted to the manifold bar 224. The guide block 300 can define a plurality of bores 302, each bore 302 in communication with a respective passageways 225. In some aspects, each bore 302 can have an inlet, opposite the manifold bar 224, and an outlet adjacent the manifold bar, wherein the inlet is larger than the outlet. For example, the bores 302 can taper from the inlet to the outlet. In this way, the bores 302 can facilitate insertion of yarns therein. In some aspects, the guide block 300 can comprise a polymer that has a low coefficient of friction with the yarn. For example, the guide block 300 can be formed from phenolic.

Conventional hollow needle tufting machines require air pressures throughout the yarn exchange process that are high enough to drive the yarns for the tufting process but low enough so that the yarns are not blown back out of the yarn exchanger due to air back pressure. The air pressures for holding and feeding the yarns for tufting are typically different, with a Low Air Pressure (LP) used for holding the yarn in a position and a High Air Pressure (HP) used for tufting or facilitating feeding of the yarns. There is also an air injector in the yarn exchanger positioned just above the top/opening of the hollow needle, referred to as the needle injector. The needle injector receives air (needle pressure) to act on and drive all yarns inside the needle through it for the tufting process. Conventional hollow needle tufting machines can include air reliefs built into the funnel block to aid in overcoming some of the back pressure issues that can arise disrupting yarn flow, but the amount of relief is limited due to other phenomena. For example, the air relief or air escape vents cannot be too large, or yarns will tend to escape the funnel block with the relief air too, diverting the yarn flow from tufting to outside the tufting and into the surrounding atmosphere. Such complications can create a machine stop and runnability issues. The running air pressures on conventional hollow needle tufting machines are typically as high as HP=80, LP=60 and needle pressure=80 PSIG, but often are run at lower pressures (e.g., HP=60, LP=40). Air pressures higher than these maximum values can cause runnability issues due to yarns blowing out of the manifold bar/yarn exchanger due to back pressures, and/or yarns drooping between a jerker (described further herein) and the manifold bar 224 during the yarn selections and insertion into the funnel block/hollow needle due to limited yarn flow velocity.

These conventional air pressures are unsuitable when tufting turf yarns. For example, in some aspects, in order to tuft turf yarns using a hollow needle tufting apparatus as disclosed herein, the HP can be set above 80 psig (for example, about 85 psig, or at least 85 psig, or at least 90 psig (e.g., from 85 psig to 120 psig or from 90 psig to 120 psig) or about 100 psig or more than 100 psig (e.g., from 100 psig to 120 psig), or above 120 psig (e.g., from 120 psig to 140 psig)). The LP can be at least 70 psig (for example, at least 75 psig (e.g., from 75 psig to 100 psig), about 80 psig, or above 80 psig (e.g., from 80 psig to 100 psig)). The needle pressure can be set above 80 psig. For example, the needle pressure can be set at at least 85 psig, or at least 90 psig (e.g., above 90 psig, from 85 psig to 120 psig, from 90 psig to 120 psig, at least 95 psig, from 95 psig to 120 psig, or about 100 psig, or more than 100 psig, or from 100 psig to 120 psig, or above 120 psig). Accordingly, consistent with the present disclosure, it has been discovered that pressures substantially higher than conventional pressures can achieve improved results when used with the yarns included in turf products. This is contrary to conventional wisdom, as high pressures are expected to cause runnability issues for tufted articles. Further, the increased pressures can enable production efficiency far exceeding conventional turf tufting machine efficiency levels.

In some optional aspects, it is contemplated that the needle pressure can be constant or substantially constant during operation.

In some optional aspects, the HP value can be equal or substantially equal to the needle pressure value.

It is further contemplated that the step of reducing the pressure from the HP setting to a LP setting (the air pressure for maintaining stationary yarn positions) can be omitted so that the air pressure provided to the yarns flowing through the hollow needles from the exchanger remains at the same HP value throughout the yarn exchange process. In other words, the pressure can remain the same for all yarns entering the yarn exchanger, and the pressure need not be modulated to a lower pressure (e.g., for maintaining stationary yarn positions).

Optionally, as further disclosed herein, the at least one yarn feed assembly 26 can comprise at least one servo motor (optionally, a plurality of servo motors), with each servo motor being configured to control delivery of a respective yarn in accordance with processor control based on an automated process, pattern file, or through instructions received from a user/operator (e.g., through a human-machine interface (HMI)).

Jerker

Referring to FIGS. 6A-6D and 9, in some aspects, the tufting apparatus can include a jerker 500. The jerker 500 can be used to insert and extract yarns from the hollow tufting needle for tufting. The jerker can comprise a clevis 502 across which the yarn moves. For example, the clevis 502 can define an opening 504 through which the yarn is fed. The jerker 500 can include an actuator 510, such as, for example, a pneumatic cylinder, a spring, or a solenoid. Optionally, in these aspects, the actuator 510 can include a pneumatic cylinder. The actuator 510 can effect movement of the clevis 502 by a sufficient distance in order to both: (a) feed a desired length of yarn (e.g., based on a predetermined cut or loop tufted pile height specification) to the needle; and (b) retract the yarn from the needle to a holding position that places the yarn out of the shared yarn flow areas.

The jerker 500 can further comprise at least one guide 520 relative to which the clevis moves and along which the yarn travels. For example, the jerker can comprise a pair of guides 520 on opposite sides of the clevis 502. The yarn can move across the guides 520 and through the clevis 520. The clevis 502 can move relative to the pair of guides 520, and the guides can be positioned relative to the clevis 502 to amplify or increase (e.g., double) the movement of yarn in response to movement of the clevis.

Figure 9:
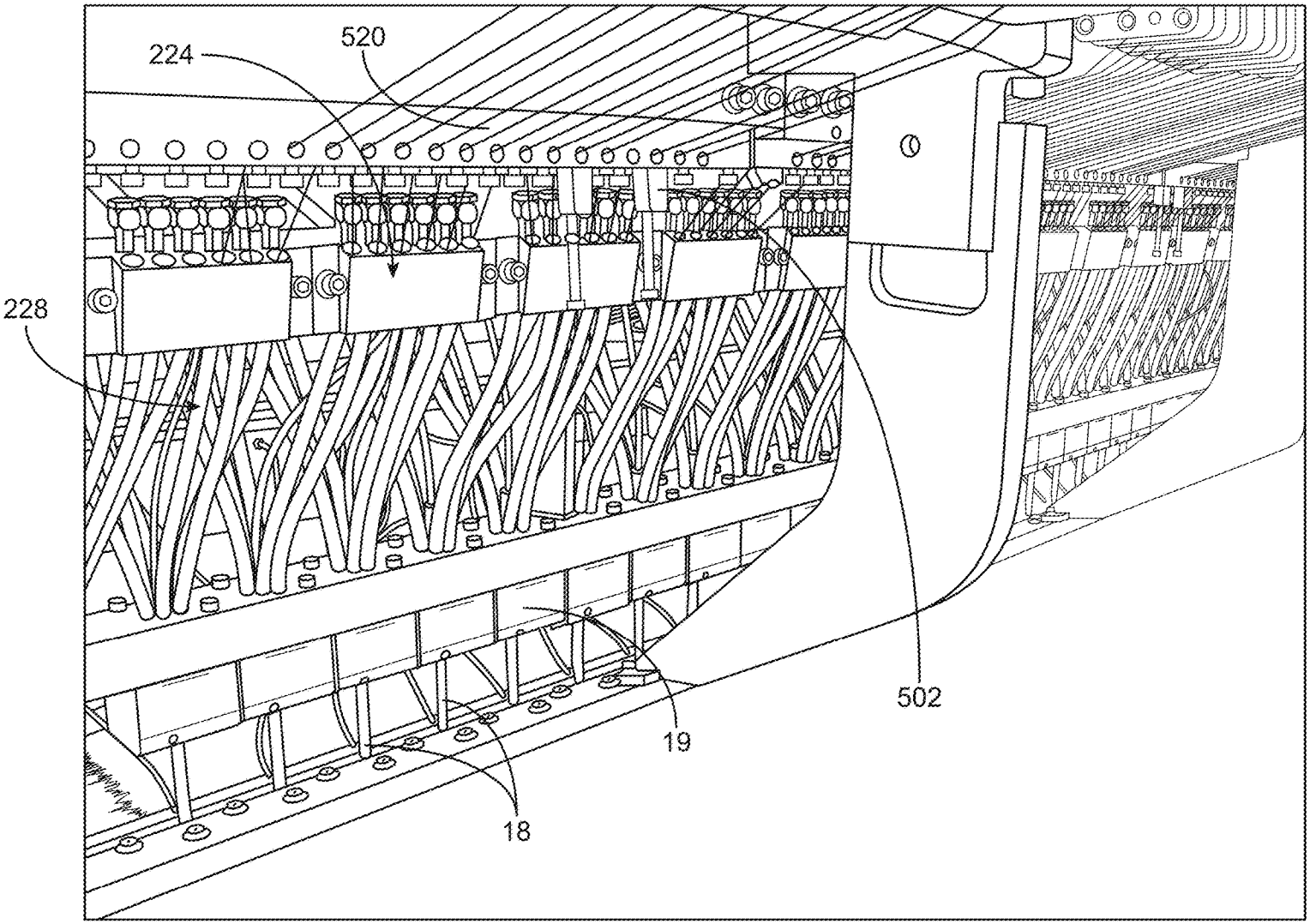
FIG. 9 is a partial perspective view of an exemplary tufting machine as disclosed herein.

A conventional jerker is shown schematically in FIGS. 6A and 6B and further depicted in FIG. 9, with reference to FIG. 7A, showing a conventional guide 520.

Conventionally, each yarn travels through a respective hole 521 in each guide 520 (FIGS. 6B and 7A). When using yarns such as turf yarns, a conventional jerker, shown in FIGS. 6A and 6B, can pinch the yarn between the clevis and the guides, particularly in the extended configuration, shown in FIG. 6A.

In some aspects, and with reference to FIGS. 6C and 6D, a guide 520' can be configured so that yarn does not extend through the guide 520'. Rather, the yarn only contacts exterior surfaces of the guide 520'. For example, rather than extending through holes 521 in the guide 520, each guide 520' can be configured so that the yarn slides along an exterior surface (e.g., a lower surface) of the guide 520'. In further aspects, the guide 520' can be configured so that the guide does not contact the yarn when the clevis 502 is in the extended position (see FIG. 6C).

Figure 7B:
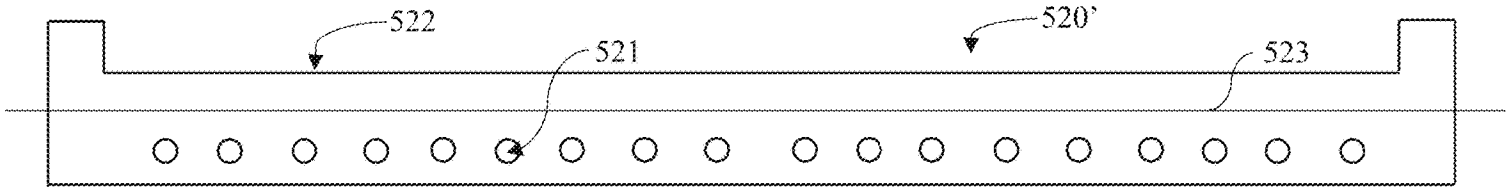
FIG. 7B is a schematic view of a guard of a jerker as disclosed herein.
Figure 7C:
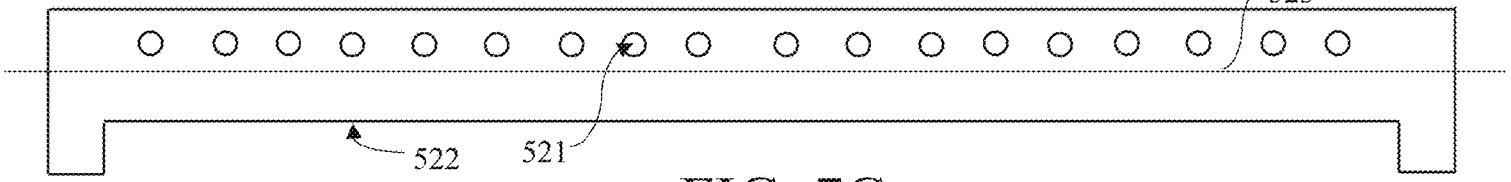
FIG. 7C is a schematic view of the guard of FIG. 7B in an inverted orientation.

Referring to FIGS. 7B and 7C, in some aspects, at least one guide 520' can be adjustable relative to the clevis 502 in order to accommodate different yarn sizes or types (e.g., conventional bulk continuous fiber and turf fiber or other large denier yarn). For example, the guide(s) 520' can be rotated or flipped (e.g., between the orientations shown in FIGS. 7B and 7C) depending on the yarn being used. In a first orientation, shown in FIG. 7B, the guide 520' can define a plurality of holes 521 that are positioned for operable use with the clevises 502, as shown in FIGS. 6A and 6B. In the second orientation, shown in FIG. 7C, the guide 520' can comprise a surface 522 that can define a guide surface for the yarn. For example, as shown in FIG. 7B, the surface 522 can be defined by a recess formed in a side of the guide 520', and the plurality of holes 521 can be provided along the length of an opposing side of the guide 520'. For the guide 520' shown in FIG. 7B, in the first orientation orientation in which the holes 521 are positioned below the surface 522 (and the holes 521 are near the bottom surface of the guide 520'), the holes 521 can be positioned to receive conventional yarn as in FIGS. 6A and 6B (with the holes 521 aligned with the opening 504 of the clevis 502). When the guide 520' shown in FIG. 7B is inverted to the position shown in FIG. 7C, and attached to the tufting machine with the same midline 523 between the upper and lower surfaces, the surface 522 can define the lower surface of the guide 520' and be positioned as illustrated in FIGS. 6C-6D, thereby allowing the surface 522 to act as the guide surface (with the holes 521 positioned vertically above surface 522).

As another example, with reference to FIGS. 6C-6D and 7B, the guide(s) 520 can be shifted vertically to achieve a desired vertical position for a particular yarn type. For example, in some aspects, the guide(s) 520 can be attached to adjustable brackets that permit selectable vertical spacing and positioning. More generally, the guide(s) 520 can attach to the frame of the tufting machine in different vertical positions. In one exemplary application, the guide(s) 520 can be vertically shifted from a first position, in which the holes 521 are positioned for operable use with the clevises 502, as shown in FIGS. 6A and 6B, to a second position (spaced upwardly relative to the first position), in which the lower side of the guide is positioned for operable use with the clevises. Accordingly, when the guides 250 are in the second position, when the clevis is retracted, the yarns can slide against the lower sides of the guides, as shown in FIG. 6C-6D, thereby preventing catching between the clevis and the guides for larger yarns. By permitting vertical adjustment of the position of the guide(s) 520, the tufting machine can be adaptable for use with different types of yarns (e.g., conventional yarns or turf yarns). Optionally, and with reference to FIGS. 6C-6D, the guide(s) 520 do not comprise holes that are configured to receive yarns. In other optional aspects, and with reference to FIGS. 7B and 7C, the guide(s) 520' that are selectively vertically positionable can have multiple use orientations, with one of the use orientations intended for use with turf yarns or other large the guides and corresponding to an arrangement in which no hole is provided for receiving yarns below the midlines.

The Control System

Figure 3:
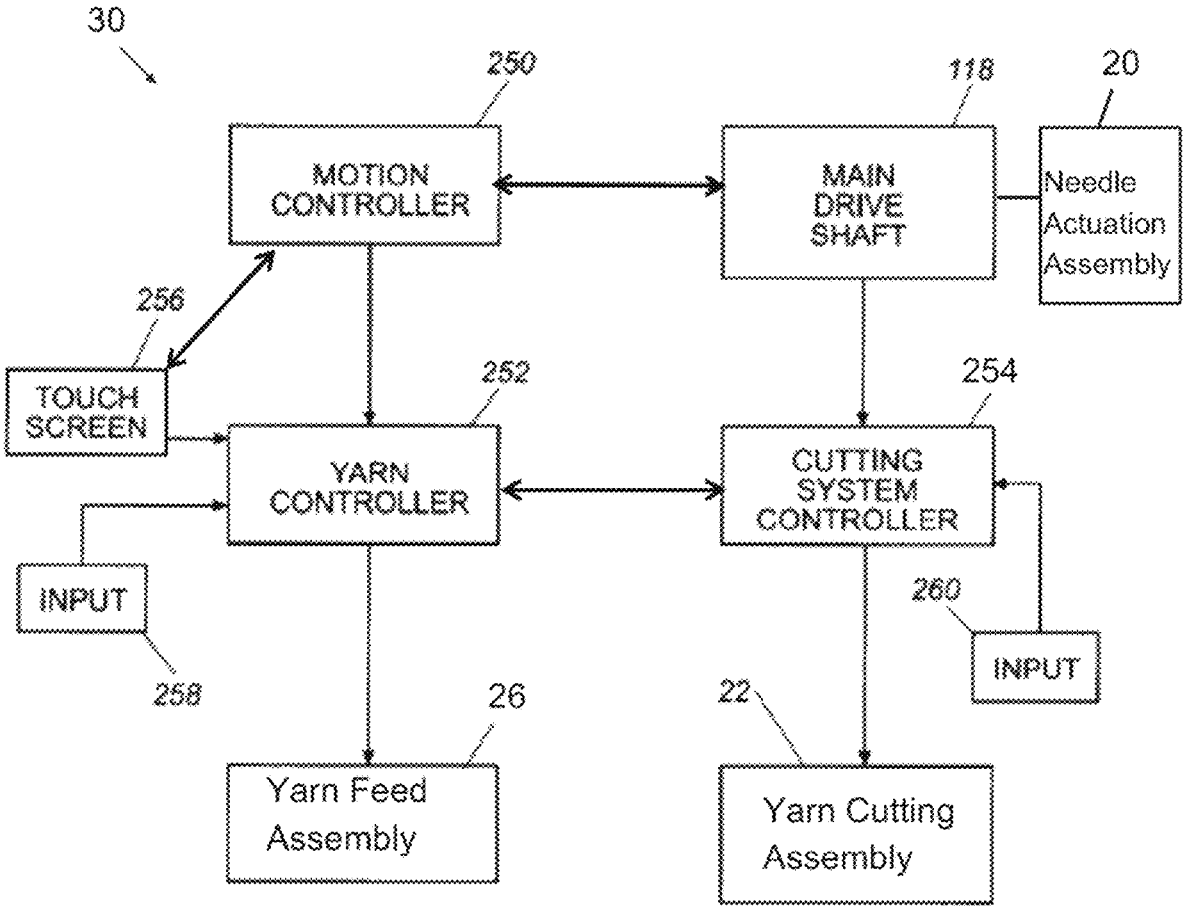
(Prior Art) FIG. 3
FIG. 3 is a schematic diagram of an exemplary control system of a tufting machine as disclosed herein.

The control system 30 of the tufting apparatus 10 can receive instructions from an operator and/or a pattern file input (separate from the operator instructions) for making a particular product such as a patterned carpet. In use, as further described herein, the control system can control the various subsystems of the tufting apparatus, including the backing transport system 14, the needle actuation assembly 20, the yarn cutting assembly 22, and the yarn feed assembly 26, in accordance with the operator's instructions to make the desired product. As shown in the schematic diagram of FIG. 3, the control system 30 for the tufting apparatus 10 can comprise a motion controller 250 for controlling the motors driving the backing transport system 16, the needle actuation assembly 20, and the yarn feed assembly 26, a yarn controller 252 (which includes at least one processor and can optionally be a computer), a yarn cutting controller 254 (which includes at least one processor and can optionally be a programmable computer), and an operator control interface 256. The function of each of the components of the control system 30 is described below in detail so that one skilled in the art can obtain or prepare the appropriate software to carry out the respective functions.

The motion controller 250 can control and coordinate the motors mounted on the tufting apparatus 10 for driving the backing transport system 16, the needle actuation assembly 20 via the main drive shaft 118, and the yarn feed assembly 26 via the driven rollers 162. The motion controller 250 can communicate with the yarn controller 252 and generate data representing the position and speed of movement of the main drive shaft 118. The motion controller can include a processor, which can be provided as a component of a computing device, such as a personal computer, a laptop computer, a tablet, a smartphone, a programmable logic controller, and the like. An exemplary motion controller is a GALIL model 1040 motion controller manufactured by GALIL Motion Control, Inc., of Sunnyville, Calif.

The yarn controller 252 can comprise at least one computing device (such as a personal computer, a laptop computer, a tablet, a smartphone, a programmable logic controller, a programmable automation controller, at least one servo drive, at least one hardware interfacing device, and the like) that is programmed with operator utility software and run time software and generally stores yarn color pattern information and controls operation of the yarn feed assembly 26 in accordance with the selected multi-colored pattern. The operator utilities software can include functions such as selecting pattern files from a pattern input 258 such as a stored pattern file, decompressing or compressing pattern files, changing pattern colors, setting up the yarn creel, and performing diagnostic functions with the yarn control input/output. Optionally, patterns such as multi-colored patterns for carpet can be scanned using a conventional multicolor pattern scanning device, translated into a pattern file, and downloaded onto a disk, flash drive, or the hard drive of the yarn controller 252. The operator can input instructions through the operator control interface 256 for the timing of the tufting operation.

The run time software can control the yarn colors and pattern generation during operation of the tufting apparatus 10. The run time software can allocate the pattern information from the pattern file to the correct needles 18 at the correct time relative to the position of the main driveshaft 118. In the event the yarn feed comprises at least one servo motor for controlling delivery of an individual yarn, the run time software can provide pattern information to each servo motor to ensure that the yarn is delivered in the correct amount and at the correct rate.

The cutting system controller 254 can comprise at least one computing device (such as a personal computer, a laptop computer, a tablet, a smartphone, a programmable logic controller, a programmable automation controller, at least one hardware interfacing device, and the like) that controls the yarn cutting assembly 22 in accordance with a cut/loop pattern so as to selectively cut the yarn and plant it in the backing to form a cut tuft or alternatively form a loop tuft, so that the tufted good has both cut tufts and looped tufts. Like the yarn controller 252, the cutter controller 254 can include operator utility software and run time software. The cutting system controller 254, however, can receive and store cut/loop pattern information from a cut/loop pattern input 260 such as a stored pattern file.

The run time software of the cutting system controller 254 can allocate the pattern information to the appropriate knife blades 113 at the correct time relative to the main shaft 118 position, and send a signal to the appropriate knife blade reciprocating mechanism 140 to selectively cut yarn or not cut yarn to form the desired cut/loop pattern. Although the yarn controller 252 and the cutting system controller 254 are synchronized, they can operate independently of one another so that yarn color patterns and cut/loop patterns can be implemented independently for each tufted good. Therefore, any yarn color pattern can be combined with any cut/loop pattern to produce a wider variety of tufted goods.

Operation of the Tufting Machine

After the tufting apparatus 10 is properly set up, the tufting apparatus can produce, in one pass, tufted patterned articles, such as carpet, carpet tiles, turf products, and the like. Optionally, the tufting apparatus 10 can be configured to produce multi-colored articles. For example, the tufting apparatus 10 can be set up to deliver six different yarns to each needle, but also could be set up to produce carpet or turf having a pattern with more or less than six colors. In addition, the tufting apparatus 10 can produce a patterned carpet or patterned turf having some cut tufts and some loop tufts. The cut and loop tufts can be arranged to form a pattern themselves independent from the yarn color pattern. Furthermore, the tufting apparatus can be set up to produce a patterned article having tufts of different pile heights in the same carpet or turf article and can be set up to produce patterned carpet or patterned turf having various tuft constructions (i.e., various gauges and stitch rates). These methods are explained in more detail below.

To set up the tufting apparatus 10, the control system 30 can first be programmed with the appropriate pattern and the timing data, and the air pressures for the pneumatic systems and the presser foot can be set via the operator control interface touch screen 256 to levels appropriate for the types of yarns being used. The yarn color pattern can be fed to the yarn controller 252 through the yarn color pattern input 258, and the cut/loop pattern can be fed to the cutting system controller 254 through the cut/loop pattern input 260. The speeds of the driven rollers 162, 71, 75 and bed plates 94, 96 in the needle actuation assembly 20 can be set to achieve the desired pile height, stitch gauge, or stitch rate for the tufts. Next, the backing 16 can be fed into the backing transport system 14, and the yarns can be mounted on the creel and fed through overhead tubes, the yarn supply mechanisms 26, and the yarn delivery tubes 228 to the yarn applicator 20.

The motion controller 250 can also be programmed with the stitch gauge of the pattern being used so that the backing advance motors, the backing shifting motors and the main drive motors cooperate to reproduce the desired pattern in the tufted product. The tufting operation can be initiated by the operator by sending a start signal to the control system 30. The backing transport system 14, the yarn applicator system 20, the yarn cutting system 22, and the yarn feed mechanism 26 can then begin simultaneous operation to produce carpet or turf having the pattern being implemented by the control system 30. Each full rotation of the main drive shaft 118 is a cycle of the tufting apparatus 10. Through the adjustable cam assemblies 110 and the link assemblies 112, the needles 18 can be reciprocated by the rotation of the main drive shaft 118. For every rotation of the main drive shaft 118, the needles 18 can reciprocate through a full cycle which includes a downstroke and upstroke. During each reciprocation cycle of the yarn applicator 20, the needles 18 can implant a yarn tuft into the backing 16. As the backing advance motors advance the backing 16 and the backing shifting motors move the backing transversely to the direction of advancement of the backing, the reciprocating needles 18 can penetrate the backing and implant yarn in the backing successively along transverse rows.

During each cycle of the tufting apparatus 10, yarns can be fed to the needles 18 by the yarn feeders 164. The yarn feeders can feed a yarn to each needle 18 during each stroke so that a yarn is tufted by each needle at each penetration of the backing 16 by the needles. In accordance with data sent by the yarn controller 252 to tufting apparatus 10, the yarn feed mechanisms 26 can feed yarn, selectively retract or not retract yarn, or hold yarn in accordance with the pattern being implemented by the yarn controller. Optionally, the yarn feed mechanisms 26 can be configured to provide unidirectional yarn flow such that they do not retract yarn.

Methods of Using Hollow Needle Tufting Machine

In some aspects, a method can comprise using a hollow needle tufting machine as disclosed herein to form a tufted article. In some aspects, the tufted article can be artificial turf. In these aspects, the hollow needle tufting machine can tuft turf yarn. In additional aspects, the tufting machine can tuft a yarn (or a plurality of yarns) having a denier of at least 4000, or at least 5000, or at least 6000, or at least 7000 (e.g., ranging from 4,000 to 25,000 or from 5,000 to 20,000). In further aspects, the tufting machine can tuft a staple fiber yarn(s) (as opposed to a bulk continuous fiber (BCF)) to form a tufted article. Optionally, in these aspects, the tufting machine can tuft one or more wool yarns to form a tufted article. In other aspects, the tufting machine can tuft BCF. In some aspects, the yarn does not comprise polyethylene terephthalate (PET). For example, the yarn can comprise polystyrene. However, in other aspects, it is contemplated that yarn comprising PET can be tufted using the disclosed methods. In various aspects, the tufting machine can tuft yarn comprising polyethylene or polypropylene. More generally, it is contemplated that any material suitable for use as an artificial turf face fiber can be used in the disclosed systems and methods. For example, in some optional aspects, it is contemplated that yarns comprising nylon and yarns comprising a combination of polymer materials can be used. In various aspects, the yarns can comprise one or more of a conventional nylon, polyester, polypropylene (PP), polyethylene (PE), polyurethane (PU), thermoplastic polyurethane (TPU), polyvinyl chloride (PVC), polyethylene terephthalate (PET), polypropylene terephthalate (PPT), polybutylene terephthalate (PBT), polytrimethylene terephthalate (PTT), ethylene vinyl acetate (EVA), latex, styrene butadiene rubber, or any combination thereof. It is contemplated that the conventional nylon of the yarns can be, for example and without limitation, nylon 6/6, nylon 6, nylon 10, nylon 10/10, nylon 10/11, nylon 11, and the like. Additionally, the yarns can comprise natural fibers, such as cotton, wool, or jute. In exemplary aspects, the yarns can comprise one or more biodegradable materials, including, for example and without limitation, polylactic acid (PLA).

As disclosed herein, the yarns can be turf yarns. That is, the yarns can be configured to simulate synthetic grass in feel (e.g., performance). In further optional aspects, the turf yarns can be configured to simulate the look (e.g., color and texture) of synthetic grass. Optionally, the disclosed turf yarns can have a denier per filament (dpf) ranging from 61 to 3600 dpf or from 100 to 3600 dpf or from 200 to 3600 dpf or from 500 to 3600 dpf. However, it is contemplated that other dpf values can be used depending on the particular application and desired performance properties.

For example, in some aspects, the turf yarn can be or comprise monofilament yarn. The monofilament yarn can be produced by extruding molten polymer through a spinneret. The monofilament can be drawn to provide a desired strength and elasticity. The shape of the cross-section of the yarn can be dictated by a spinneret hole and can be, for example and without limitation, a diamond shape, a serrated diamond shape, a half-moon shape, or an oval or round shape. The monofilament yarns can comprise multiple filaments, such as, for example, from about 2 to about 20 filaments, or from about 6 to about 12 filaments, or 6, 8, or 12 filaments. In some optional aspects, each filament can simulate a blade of grass. The filaments can be provided in various deniers and colors. In exemplary aspects, the monofilament yarn can comprise, for example, 7200 denier to 10800 denier. For example, the yarn can be from 7200 denier/4 filament (1,800 denier per filament/blade)–10800 denier/6 filament (1,800 denier per filament/blade).

In some aspects, the turf yarn can be or comprise thatch/texturized yarn. Thatch/texturized can be a specialized type of monofilament yarn. Thatch/texturized yarn is available in various deniers, texture levels, and colors. These yarns can be used below the face yarn in artificial turf to enhance the turf's ability to recover. In exemplary aspects, the thatch/texturized yarn can have a denier from 4500-5000 (e.g., 4500 denier/8 filament (562 denier per filament/blade)–5000 denier/8 filament (625 denier per filament/blade)).

In some aspects, the turf yarn can be or comprise tape/fibrillated yarn. Tape/fibrillated yarns can be formed by extruding a thin film that is subsequently cut into small strips and fibrillated, resulting in a honeycomb-like structure. The process creates a soft, natural-looking surface. They are available in various deniers and colors. For example, an exemplary denier range for tape/fibrillated yarn can be from 5000 denier to 9000 denier.

Articles Formed Using Hollow Needle Tufting Machine

Figure 10:
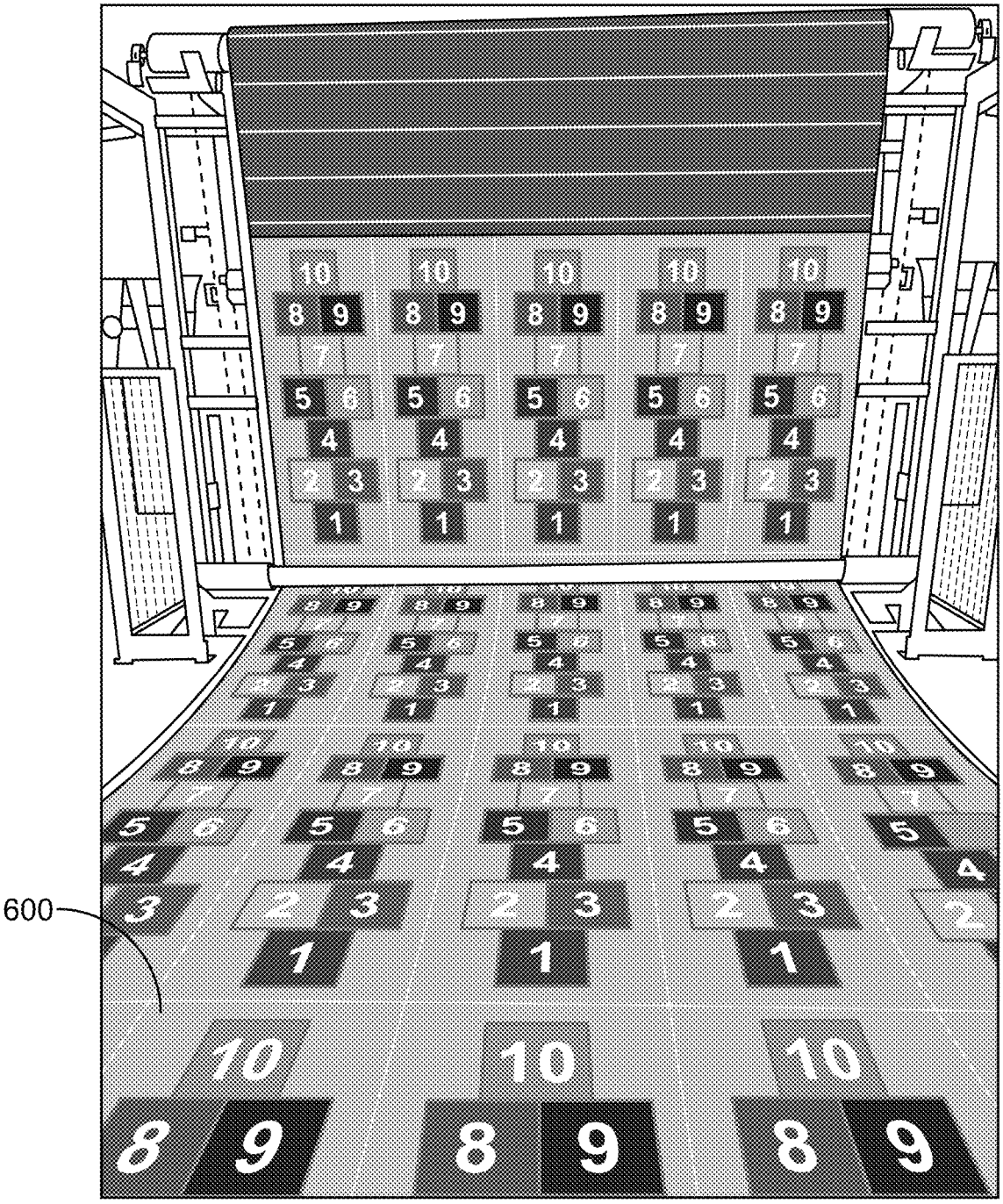
FIG. 10 is an exemplary article being formed on a system as disclosed herein, the article having six different colors.

Referring to FIG. 10, in some aspects, an article 600 can comprise turf yarns. Tuft spacing can be from ½ gauge to 20 gauge. For example, tuft spacing can be at least 8 gauge (e.g., from 8 gauge to 16 gauge). In some aspects, tuft spacing can be from about ¼ inch to 3 inches, or from about ½ inch to about two inches, or about ½ inch or about 1 inch or about 1.5 inches or about 2 inches. An article formed by the hollow needle tufting machine is disclosed. For example, in some aspects, the hollow tufting needles can form openings in the backing that are larger than when tufting with conventional (non-hollow) needles.

Figure 15:
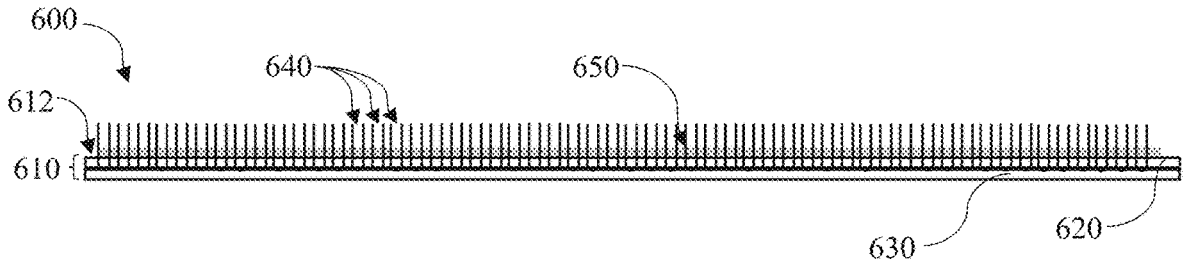
FIG. 15 is a schematic side view of a tufted article as disclosed herein.

Referring also to FIG. 15, the disclosed tufted article 600 can comprise a backing 610 having a top surface 612. Tufts 640 can extend upwardly from the top surface 612 of the backing. It is contemplated that the backing 610 can have any conventional structure that is suitable for supporting a particular playing surface assembly as described further herein. In exemplary aspects, the backing 610 can comprise a single layer of backing material. Alternatively, in other exemplary aspects, the backing 610 can comprise a plurality of layers, such as, for example and without limitation, a primary backing layer 620 and at least one secondary backing layer 630 (optionally, a plurality of secondary backing layers). In some aspects, the secondary backing 630 can be attached to the primary backing 620 via adhesive. Optionally, in some aspects, the backing 610 can be or comprise a woven backing. Optionally, in other aspects, the backing 610 can be or comprise a non-woven backing. Optionally, in some aspects, the backing can be permeable to liquid. Optionally, in other aspects, the backing can be impermeable to liquid.

In some aspects, the primary backing, through which tufts 640 are tufted, can be a single ply primary backing. Optionally, the weight can be about double the weight of a conventional primary backing. Additionally, the thickness can be about double the thickness of a conventional primary backing. For example, conventional primary backings usually have a weight within a range of 3 oz/yd$^2$ to 4 oz/yd$^2$. In some aspects, the backing of the disclosed article can have a weight from 5 oz/yd$^2$ to 8 oz/yd$^2$, or from 6 oz/yd$^2$ to 7 oz/yd$^2$ (e.g., between 6.2 and 6.4 oz/yd$^2$). In exemplary aspects, the primary backing can be woven. For example, the primary backing can have 13 picks (weft threads) per inch by 22 warp rows per inch.

In some aspects, the article can comprise at least 2 different types of yarn, at least 3 different types of yarn, at least 4 different types of yarn, at least 5 different types of yarn, or at least 6 different types of yarn. For example, the article can comprise at least 2 different colors of yarn, at least 3 different colors of yarn, 4 different colors of yarn, at least 5 different colors of yarn, or at least 6 different colors of yarn. In some aspects, one or more rows of tufts (e.g., rows extending the along the axis the backing moves relative to the tufting machine) can comprise at least 2 different types of yarn, at least 3 different types of yarn, 4 different types of yarn, at least 5 different types of yarn, or at least 6 different types of yarn. The different types (e.g., different color, yarn type, or yarn size) of yarn can be provided in different regions to form a particular pattern. The particular pattern can be, for example, a logo, symbol, graphics, text, aesthetic appearance, or combinations thereof. In further aspects, the different regions can have different pile heights. Thus, for example, a first region within a pattern can have a first pile height, and a second region within the same pattern (optionally, adjacent to the first region) can have a second pile height that is greater than or less than the first pile height. Optionally, in this example, the first region can include at least one yarn (optionally, a plurality of yarns) that is of a different color than any yarn within the second region. In further optional aspects, the yarn(s) within the first region can all be identical or substantially identical, and the yarn(s) within the second region can all be identical or substantially identical.

Optionally, in exemplary aspects, the tufted articles can comprise artificial turf articles (e.g., artificial turf panels). In further optional aspects, and as further disclosed herein, it is contemplated that the surface covering can be at least a portion of a sports field, such as a baseball field, a football field, a tennis court, a golf course, a cricket field, a soccer field, a pickleball court and the like. In exemplary aspects, it is contemplated that complementary patterned regions of adjacent tufted articles can cooperate to form particular sections of a sports field, such as, for example and without limitation, a tee box, fairway, rough, approach, collar, and/or green of a golf course, a grass, skin, and/or track area of a baseball field, a grass and/or pitch area of cricket grounds, white line sections for a tennis court, and the like. The particular pattern formed by the different types (e.g., colors) of yarns in different regions can cooperate to form markings that allow for usage of the field without the need for using separate processes (e.g., cutting, patching, and the like). Such markings include, for example and without limitation, boundaries, hash marks, yard marks, and other markings that are required for play.

Optionally, a plurality of such articles can be provided to form a surface covering, or a portion thereof. For example, the articles can form some of or an entirety of an athletic field, such as, for example and without limitation, a baseball field, a football field, a tennis court, a golf course, a cricket field, a lacrosse field, a field hockey field, a soccer field, or a pickleball court.

In some aspects, the articles can have a length of at least 80 feet, or at least 90 feet, or at least 150 feet. For example, the articles can be configured to extend an entirety of, or substantially an entire dimension of a playing area of a sports field (e.g., a football field, a soccer field, a tennis court, or a pickleball court.) Additional exemplary patterns consistent with articles and surface coverings disclosed herein are described in U.S. patent application Ser. No. 17/476,870, filed Sep. 16, 2021, the entirety of which is incorporated by reference herein for all purposes.

In still further aspects, it is contemplated that the disclosed articles can be used in landscaping, commercial, residential, or industrial applications. For example, it is contemplated that the articles disclosed herein can be used to form surface coverings that are positioned in various open spaces, such as for example, and without limitation, a park, an airport runway, a landfill cover, a home or office lawn or greenspace, an indoor or outdoor gathering space, or the like. Optionally, in these applications, it is contemplated that the tufted articles can be provided with wayfinding markings, logos, graphics, text, or combinations thereof.

Optionally, the tufted article 10 can comprise infill 6500 (e.g., sand). The infill can optionally be provided at a weight ranging from about 1 lb/sq. yard to about 9 lb/sq. yard. In these aspects, it is contemplated that the infill can comprise a single component or any combination of a plurality of components. When the infill comprises a plurality of components, it is contemplated that the infill material can optionally comprise a plurality of layers, with each layer corresponding to a different infill component or combination of components. Alternatively, it is contemplated that the plurality of components can be provided as a mixture, which can be either homogenous or non-homogenous. In exemplary aspects, it is contemplated that the infill can comprise clay, TPE, EPDM, coconut husks, walnut shells, crushed brick, sand, or combinations thereof. More generally, it is contemplated that the infill can comprise any material that is capable of imparting desired characteristics to a surface covering (e.g., a floor or ground covering) as disclosed herein. In further aspects, the tufted article 10 does not comprise infill (and is not filled during use).

Advantages of Using Disclosed Hollow Needle Tufting Machine and Methods

With conventional hollow needle tufting machines, certain yarns, such as larger (e.g., turf) yarns, will not typically flow well through the jerker and associated guides or enter air manifold block openings to the yarn conduits leading to the funnel block and needle. Due to physical restraints and friction, certain yarns will not flow well through the air manifold block conduits and into the hollow needle. Staple yarns have similar inherent issues as the larger yarns, as short staples protruding from the yarns restrict yarn flow, particularly into and through the air manifold block conduits, and many times interact with other yarns flowing into and out of the funnel block and hollow zones during the yarn exchange process (yarns that are passing in these shared areas). The unfavorable staple yarn interaction results in yarns mixing or entangling together in the funnel block and/or needle, resulting in the yarn flow stopping, machine stops, and service required to clear the resultant air entanglements before tufting can continue. Notwithstanding these issues, many staple yarns and/or untwisted yarns have inherent and undesirable yarn interactions before the yarn feed mechanisms and after the yarn feed mechanisms, before the jerker. Adjacent yarns tend to mix and entangle together as they twist or rotate during tufting machine feeding or any yarn movement (e.g., as the yarns exit the creel tubing or header that is conventionally fixed above the tufting machine), thereby entangling the yarns together, inhibiting yarn flow during and for the tufting process and forcing a machine stop to service the yarn coming into the jerkers. These phenomena can prevent the conventional yarn tufting machines from running at acceptable run-efficiency levels and/or can cause tufting machine down time or articles of deficient quality.

The disclosed tufting machine can address one or more of these deficiencies. For example, the disclosed manifold bar can reduce friction of yarn passing therethrough. Further, the disclosed jerker can prevent pinching yarns between the clevis and the guides. The increased air pressures provided in the yarn exchange process can permit turf-tufting efficiency exceeding historical speeds. Additionally, the reduced foot injector pressures can improve operation and tufted article (e.g., tufted artificial turf) quality.

EXEMPLARY ASPECTS

In view of the described products, systems, and methods and variations thereof, herein below are described certain more particularly described aspects of the invention. These particularly recited aspects should not however be interpreted to have any limiting effect on any different claims containing different or more general teachings described herein, or that the "particular" aspects are somehow limited in some way other than the inherent meanings of the language literally used therein.

Aspect 1: A system comprising:

a pair of guides; and a clevis movable between the pair of guides, wherein the clevis defines an opening therethrough, wherein the clevis and pair of guides are configured to engage a yarn to so that the yarn contacts only exterior surfaces of the pair of guides.

Aspect 2: The system of aspect 1, further comprising a yarn extending through the opening through the clevis, wherein the yarn contacts only exterior surfaces of the pair of guides.

Aspect 3: The system of aspect 1 or aspect 2, wherein the pair of guides comprise a plurality of openings therethrough, wherein:

in a first orientation, the pair of guides are configured to receive yarn through the plurality of openings; and in a second orientation, the pair of guides are configured so that yarn contacts only the exterior surfaces of the pair of guides.

Aspect 4: The system of any one of the preceding aspects, wherein each guide of the pair of guides comprises a recess formed on a side of the respective guide.

Aspect 5: The system of aspect 2, wherein the yarn contacts respective lower sides of the pair of guides.

Aspect 6: The system of any one of the preceding aspects, wherein the pair of guides do not include holes configured to receive yarns below respective midlines of the pair of guides.

Aspect 1A: A system for use within a hollow needle tufting machine, comprising: a pair of guides; and a clevis movable between the pair of guides, wherein the clevis defines an opening therethrough, wherein, in a use orientation, the clevis and pair of guides are configured to engage a yarn so that the yarn contacts only exterior surfaces of the pair of guides.

Aspect 2A: The system of aspect 1A, further comprising a yarn extending through the opening through the clevis, wherein the yarn contacts only exterior surfaces of the pair of guides.

Aspect 3A: The system of aspect 1A, wherein the pair of guides comprise a plurality of openings therethrough, wherein: in a second use orientation different from the first use orientation, the pair of guides are configured to receive yarn through the plurality of openings.

Aspect 4A: The system of aspect 1A, wherein each guide of the pair of guides comprises a recess formed on a side of the respective guide.

Aspect 5A: The system of aspect 2A, wherein the yarn contacts respective lower sides of the pair of guides.

Aspect 6A: The system of aspect 1A, wherein the pair of guides do not include holes configured to receive yarns below respective midlines of the pair of guides.

Aspect 7: A method comprising:

tufting, by a hollow needle tufting machine, a yarn through a backing, wherein the method does not comprise applying, using a pressure foot injector, a pressure of greater than 10 psi.

Aspect 8: The method of aspect 7, wherein the method does not comprise applying any air pressure via the pressure foot injector.

Aspect 9: The method of aspect 7 or aspect 8, wherein the yarn is a turf yarn.

Aspect 9A: The method of any one of aspects 7-9, wherein the method is performed using the system of any one of aspects 1-6A.

Aspect 10: A method comprising:

applying a first pressure of above 90 psig for feeding or tufting a yarn; and applying a pressure to a needle injector, wherein the pressure to the needle injector is above 90 psig.

Aspect 11: The method of aspect 10, further comprising applying a second pressure for holding the yarn, wherein the second pressure is lower than the first pressure.

Aspect 12: The method of aspect 11, wherein the second pressure is above 70 psig.

Aspect 13: The method of any one of aspects 10-12, wherein the yarn is a turf yarn.

Aspect 13A: The method of any one of aspects 10-13, wherein the method is performed using the system of any one of aspects 1-6A.

Aspect 14: An artificial turf article formed using the systems and methods disclosed herein.

Aspect 15: The artificial turf article of aspect 14, wherein the tufts have a spacing above 8 gauge.

Aspect 16: A system comprising:

a manifold bar defining a plurality of openings configured to receive a respective yarn, wherein each opening extends along an axis that meets a vertical axis at an angle of at least 14 degrees.

Aspect 17: The system of aspect 16, wherein each opening extends along an axis that meets a vertical axis at an angle of from about 14 degrees to about 20 degrees.

Aspect 18: A hollow needle tufting machine comprising the system of any one of aspects 1-6A.

Aspect 19: A hollow needle tufting machine comprising the system of any one of aspects 1-6.

Aspect 20: The hollow needle tufting machine of aspect 19, further comprising:

a frame, wherein the pair of guides are coupled to the frame, wherein the clevis is movably coupled to the frame;

a manifold bar;

a needle mounting bar;

a plurality of needles mounted to the needle mounting bar; and a plurality of yarn delivery tubes extending from the manifold bar to the needle mounting bar, wherein the yarn extends through the clevis, into the manifold bar, through a yarn delivery tube of the plurality of yarn delivery tubes.

Although several embodiments of the invention have been disclosed in the foregoing specification, it is understood by those skilled in the art that many modifications and other embodiments of the invention will come to mind to which the invention pertains, having the benefit of the teaching presented in the foregoing description and associated drawings. It is thus understood that the invention is not limited to the specific embodiments disclosed hereinabove, and that many modifications and other embodiments are intended to be included within the scope of the appended claims. Moreover, although specific terms are employed herein, as well as in the claims which follow, they are used only in a generic and descriptive sense, and not for the purposes of limiting the described invention, nor the claims which follow.

What is claimed is:

1. A method comprising:

forming a tufted article by tufting, by a hollow needle tufting machine, at least one yarn through a backing, wherein the hollow needle tufting machine comprises a system, the system comprising:

a pair of guides spaced along a first axis; and an arm that is reciprocally linearly movable along a second axis between the pair of guides, wherein the arm defines a through bore through which a first yarn of the at least one yarn extends, wherein forming the tufted article further comprises retracting the first yarn from a needle of the hollow needle tufting machine by moving the arm along the second axis from a first position to a second position, and wherein the first yarn contacts only exterior surfaces of the pair of guides.

2. The method of claim 1, wherein the method does not comprise applying any air pressure via a pressure foot injector.

3. The method of claim 1, wherein the first yarn is a turf yarn.

4. The method of claim 1, wherein the hollow needle tufting machine has a plurality of needles, wherein sequential needles of the plurality of needles are spaced by a spacing that is from ½ inch to 2 inches.

5. The method of claim 4, wherein the first yarn is a turf yarn.

6. The method of claim 1, wherein the hollow needle tufting machine has only one single row of needles.

7. The method of claim 1, further comprising moving each guide of the pair of guides from a first use orientation to a second use orientation, wherein the pair of guides each comprise a plurality of openings therethrough; and threading each yarn of the plurality of yarns through a respective opening of the plurality of openings of each guide of the pair of guides.

8. The method of claim 1, wherein each guide of the pair of guides comprises a recess formed on a side of the respective guide.

9. The method of claim 1, wherein the first yarn contacts respective lower sides of the pair of guides.

10. The method of claim 1, wherein the pair of guides do not include holes configured to receive yarns below respective midlines of the pair of guides.

11. The method of claim 1, wherein the hollow needle tufting machine further comprises:

a frame, wherein the pair of guides are coupled to the frame, wherein the arm is movably coupled to the frame;

a manifold bar;

a needle mounting bar;

a plurality of needles mounted to the needle mounting bar; and a plurality of yarn delivery tubes extending from the manifold bar to the needle mounting bar, wherein the yarn extends through the arm, into the manifold bar, through a yarn delivery tube of the plurality of yarn delivery tubes.

12. The method of claim 1, wherein the hollow needle tufting machine comprises a pressure foot injector, and wherein the pressure foot injector applies no pressure greater than 10 psi while forming the tufted article.

13. The method of claim 12, wherein the pressure foot injector applies a pressure from 1 psig to 5 psig while forming the tufted article.

14. The method of claim 12, wherein the pressure foot injector applies no pressure while forming the tufted article.

15. The method of claim 1, wherein the arm holds the first yarn away from contact with the exterior surfaces of the pair of guides when the yarn is in the first position.

16. A method of using a hollow needle tufting machine, the method comprising:

applying a first pressure of above 90 psig through a manifold bar of the hollow needle tufting machine for feeding a yarn therethrough; and applying a needle injector pressure to a needle injector of the hollow needle tufting machine to advance the yarn through a hollow needle of the hollow needle tufting machine, wherein the needle injector pressure applied to the needle injector is above 90 psig, wherein the hollow needle tufting machine further comprises a system, the system comprising:

a pair of guides spaced along a first axis; and an arm that is reciprocally linearly movable along a second axis between the pair of guides, wherein the arm defines a through bore through which the yarn extends; and wherein the method of using the hollow needle tufting machine further comprises retracting the yarn from a needle of the hollow needle tufting machine by moving the arm along the second axis from a first position to a second position, and wherein the yarn contacts only exterior surfaces of the pair of guides.

17. The method of claim 16, further comprising, following applying the first pressure through the manifold bar, applying a second pressure through the manifold bar for holding the yarn, wherein the second pressure is lower than the first pressure.

18. The method of claim 17, wherein the second pressure is above 70 psig.

19. The method of claim 16, further comprising feeding the yarn through a respective opening of a plurality of openings through the manifold bar, wherein each opening extends along an axis that meets a vertical axis at an angle of at least 14 degrees.

20. The method of claim 19, wherein each opening extends along an axis that meets a vertical axis at an angle of from about 14 degrees to about 20 degrees.

* * * * *